US010091840B2

(12) United States Patent
Kagaya et al.

(10) Patent No.: US 10,091,840 B2
(45) Date of Patent: Oct. 2, 2018

(54) ELECTRICALLY-HEATED WINDOW SHEET MATERIAL

(71) Applicant: Asahi Glass Company, Limited, Tokyo (JP)

(72) Inventors: Osamu Kagaya, Tokyo (JP); Hiromasa Tominaga, Tokyo (JP); Tomohiro Takahashi, Tokyo (JP)

(73) Assignee: AGC Inc., Tokyo (JP)

( * ) Notice: Subject to any disclaimer, the term of this patent is extended or adjusted under 35 U.S.C. 154(b) by 487 days.

(21) Appl. No.: 14/800,749

(22) Filed: Jul. 16, 2015

(65) Prior Publication Data

US 2015/0319808 A1 Nov. 5, 2015

Related U.S. Application Data

(63) Continuation of application No. PCT/JP2014/051149, filed on Jan. 21, 2014.

(30) Foreign Application Priority Data

Jan. 21, 2013 (JP) ..... 2013-008781

(51) Int. Cl.
*H05B 3/06* (2006.01)
*H05B 3/84* (2006.01)
*H05B 3/02* (2006.01)

(52) U.S. Cl.
CPC ..... *H05B 3/84* (2013.01); *H05B 3/023* (2013.01); *H05B 2203/007* (2013.01); *H05B 2203/011* (2013.01); *H05B 2203/013* (2013.01)

(58) Field of Classification Search
CPC .... H05B 3/84; H05B 3/023; H05B 2203/007; H05B 2203/011; H05B 2203/013;
(Continued)

(56) References Cited

U.S. PATENT DOCUMENTS 2,557,983 A * 6/1951 Linder ..... C03C 17/3411 106/1.14
3,982,092 A * 9/1976 Marriott ..... H05B 3/84 219/203

(Continued)

FOREIGN PATENT DOCUMENTS

EP 0 726 232 A2 8/1996
GB 2 381 179 4/2003

(Continued)

OTHER PUBLICATIONS

English Language Translation of JP03-25355.*

(Continued)

*Primary Examiner* — Dana Ross
*Assistant Examiner* — Joseph Iskra
(74) *Attorney, Agent, or Firm* — Oblon, McClelland, Maier & Neustadt, L.L.P.

(57) ABSTRACT

An electrically-heated window sheet material includes a heatable transparent conductive film, and bus bars for supplying electricity to the transparent conductive film. The bus bars includes left and right bus bars connected to left and right edges of the transparent conductive film. The transparent conductive film includes a band-shaped first region interposed between the left and right bus bars, a band-shaped second region interposed between the left and right bus bars, and openings provided in the first region. A distance between the left and right bus bars is shorter in the first region than in the second region. The openings are arranged so that a current flowing in the first region from one of the left and right bus bars to the other of the left and right bus bars is bypassed at least once by the openings.

20 Claims, 16 Drawing Sheets

(58) Field of Classification Search
CPC ..... H05B 3/86; H05B 2203/008; H05B 2203/031; B32B 2605/006; B32B 2307/202; B32B 17/10192; B32B 17/10174; B32B 17/10183
USPC ..... 219/522
See application file for complete search history.

(56) References Cited

U.S. PATENT DOCUMENTS

| | | | | |
|---|---|---|---|---|
| 5,867,129 | A * | 2/1999 | Sauer | B32B 17/10036 343/704 |
| 6,559,419 | B1 | 5/2003 | Sol et al. | |
| 2002/0015824 | A1* | 2/2002 | Kawamoto | B32B 17/10036 428/156 |
| 2005/0178756 | A1* | 8/2005 | Degand | H05B 3/84 219/203 |
| 2006/0010794 | A1 | 1/2006 | Walton et al. | |
| 2007/0187382 | A1 | 8/2007 | Mauser | |

FOREIGN PATENT DOCUMENTS

| | | |
|---|---|---|
| JP | 60-195251 | 12/1985 |
| JP | 61-127062 | 8/1986 |
| JP | 3-25355 | 3/1991 |
| JP | 5-84546 | 11/1993 |
| JP | 8-250915 | 9/1996 |
| JP | 2008-056225 | 3/2008 |

OTHER PUBLICATIONS

English Language Translation of JP2008-56225.*
International Search Report dated Apr. 28, 2014 in PCT/JP2014/051149 filed Jan. 21, 2014.
Extended Search Report dated Jul. 19, 2016 in European Patent Application No. 14740759.7.
U.S. Appl. No. 14/801,318, filed Jul. 16, 2015, Kagaya, et al.

* cited by examiner

ELECTRICALLY-HEATED WINDOW SHEET MATERIAL

CROSS-REFERENCE TO RELATED APPLICATION

This application is a U.S. continuation application filed under 35 USC 111(a) claiming benefit under 35 USC 120 and 365(c) of PCT application JP2014/051149, filed Jan. 21, 2014, which claims priority to Application Ser. No. 2013-008781, filed in Japan on Jan. 21, 2013. The foregoing applications are hereby incorporated herein by reference.

TECHNICAL FIELD

The present invention relates to an electrically-heated window sheet material including a transparent conductive film and multiple bus bars for supplying electricity to the transparent conductive film.

BACKGROUND ART

Conventionally, an electrically-heated window sheet material having a transparent conductive film is known (see for example, Patent Document 1). Bus bars are connected to both ends of a transparent conductive film formed in the electrically-heated window sheet material. One bus bar is connected to a direct current source whereas the other bus bar is grounded. When electricity is allowed to flow through the transparent conductive film, the transparent conductive film generates heat, so that fog (water drops) or the like formed on the electrically-heated window sheet material can be removed. Because it is difficult for electromagnetic waves to be transmitted due to the forming of the transparent conductive film, Patent Document 1 discloses multiples openings systematically arranged to allow electromagnetic waves of a predetermined frequency to be transmitted.

PRIOR ART DOCUMENT

Patent Document

Patent Document 1: U.S. Patent Publication No. 2006/0010794

DISCLOSURE OF THE INVENTION

Problems to be Solved by the Invention

In a case where the electrically-heated window sheet material such as a window glass of an automobile has a substantially trapezoid shape, the transparent conductive film is also formed into a substantially trapezoid shape. In a case where bus bars are provided on both left and right edges of the substantially trapezoidal transparent conductive film, the distance between bus bars becomes different between upper and lower sides. Therefore, electric current may concentrate at a part of the transparent conductive film where the distance between the bus bars is short. This may lead to local regions being heated to high temperature.

In view of the above-described problem, an object of an embodiment of the present invention is to provide an electrically-heated window sheet material that can improve a problem of local regions being heated to high temperature.

Means of Solving the Problems

In order to achieve the above-described object, an embodiment of the present invention provides an electrically-heated window sheet material includes a heatable transparent conductive film, and bus bars for supplying electricity to the transparent conductive film. The bus bars includes left and right bus bars connected to left and right edges of the transparent conductive film. The transparent conductive film includes a band-shaped first region interposed between the left and right bus bars, a band-shaped second region interposed between the left and right bus bars, and openings provided in the first region. A distance between the left and right bus bars is shorter in the first region than in the second region. The openings are arranged so that a current flowing in the first region from one of the left and right bus bars to the other of the left and right bus bars is bypassed at least once by the openings.

EMBODIMENTS FOR CARRYING OUT THE INVENTION

Figure 1:
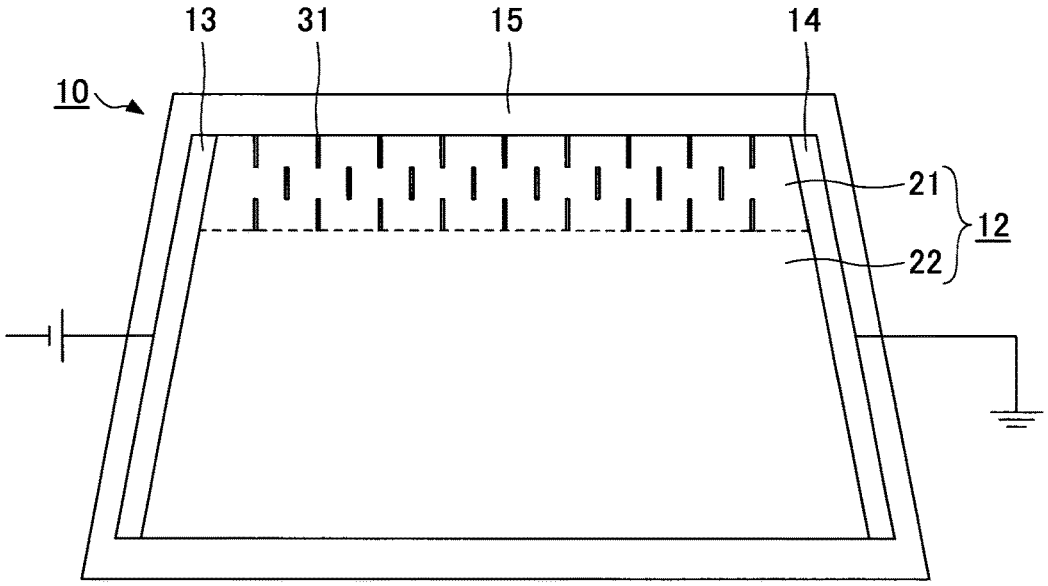
FIG. 1 is a schematic diagram illustrating an electrically-heated window sheet material according to an embodiment of the present invention.

Next, embodiments of the present invention are described with the accompanying drawings. It is to be noted that like components and parts are denoted with like reference numerals and further explanation thereof may be omitted. In describing the embodiments with the drawings, directions refers to directions in the drawings unless described as otherwise. The directions in each of the drawings correspond to the directions indicated with symbols and numerals. Further, directions such as parallel or orthogonal may deviate to the extent of not reducing the effects of the present invention. Further, each drawing is a drawing viewed from a side facing the window sheet material. Although each of the drawings illustrates an inside-vehicle view of the window sheet material in a state where the window sheet material is attached to a vehicle, the drawings may be outside-vehicle views. Upper and lower directions in each of the drawings correspond to upper and lower directions of a vehicle. A lower side of each of the drawings corresponds to a side of a road surface. Further, in a case where the window sheet material is a front glass attached to a front part of a vehicle, a horizontal direction in a drawings corresponds to a vehicle width direction of the vehicle. Further, the window sheet material is not limited to a front glass of a vehicle but may also be a rear glass attached to a rear part of the vehicle or a side glass attached to a side part of the vehicle.

Figure 2:
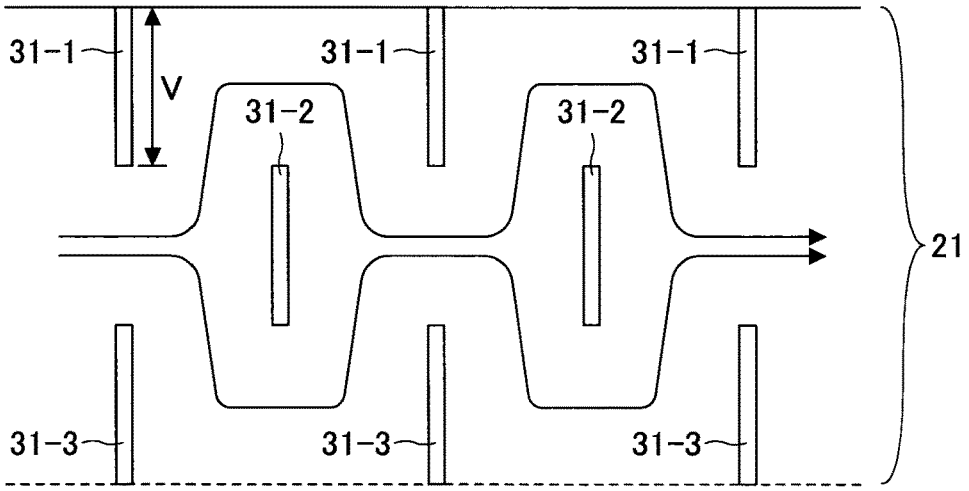
FIG. 2 is a schematic diagram illustrating an opening pattern of a transparent conductive film according to an embodiment of the present invention.

FIG. 1 is a schematic view illustrating an electrically-heated window sheet material according to an embodiment of the present invention. The broken line in FIG. 1 is an imaginary line indicating a border between a band-shaped first region and a band-shaped second region. FIG. 2 is a schematic diagram illustrating an opening pattern of multiple openings provided in a transparent conductive film according to an embodiment of the present invention. The arrows in FIG. 2 indicate paths of electric current. The paths of electric current are illustrated for the sake of convenience and are not necessarily accurate.

An electrically-heated window sheet material 10 is attached to a window opening part of a vehicle. The electrically-heated window sheet material 10 may be, for example, attached to a window of a front part of a vehicle, that is, provided on a front side of a driver of the vehicle.

As illustrated in FIG. 1, the electrically-heated window sheet material 10 includes a substantially trapezoidal window sheet material 15, a substantially trapezoidal transparent conductive film 12 provided in the window sheet material 15, and a left bus bar 13 and a right bus bar 14 for supplying electric power to the transparent conductive film 12. The term "substantially trapezoidal" may refer to a shape in which an upper side is shorter than a lower side, and preferably a shape in which the length difference between the upper side and the lower side is greater than or equal to 10%. The window sheet material 15 may include multiple transparent sheets such as glass sheets that are layered interposed by a resin intermediate film. The transparent conductive film 12, the left bus bar 13, and the right bus bar 14 may be provided between multiple insulating transparent sheets. In this case, a conductive sheet connected to each bus bar may be extracted from an end surface of the window sheet material 15 to be used as an electrode. The left bus bar 13 is electrically connected to an electric power source whereas the right bus bar 14 is grounded. When electricity is supplied to the transparent conductive film 12, the transparent conductive film 12 generates heat, so that fog or the like created on the electrically-heated window sheet material 10 can be removed to ensure visibility for a driver of a vehicle.

In this embodiment, the left bus bar 13 is electrically connected to a power source whereas the right bus bar 14 is grounded. Alternatively, the left bus bar 13 may be grounded whereas the right bus bar 14 is electrically connected to a power source.

The electrically-heated window sheet material 10 may have a curved shaped projecting to the outside of a vehicle. The electrically-heated window sheet material 10 may be fabricated by bend-molding and applying heat to a transparent sheet deposited with the transparent conductive film 12. Alternatively, the electrically-heated window sheet material 10 may be fabricated by adhering a resin sheet deposited with a transparent conductive film onto a bend-molded transparent sheet.

The transparent conductive film 12 may be formed of, for example, a metal film (e.g., Ag film), a metal oxide film (e.g., ITO (Indium Tin Oxide) film), or a resin film containing fine conductive particles. The transparent conductive film 12 may be formed of layers of different kinds of films.

The transparent conductive film 12 may be formed on an insulating transparent sheet. The transparent sheet may be formed of an insulating material such as glass or resin. The glass for forming the transparent sheet may be, for example, soda-lime glass. The resin for forming the transparent sheet may be, for example, polycarbonate (PC).

A method for depositing the transparent conductive film 12 may be, for example, a dry-coating method. The dry-coating method may be, for example, a PVD method or a CVD method. Among the PVD methods, a vacuum evaporation method, a sputtering method, or an ion-plating method is preferable. Among these methods, the sputtering method capable of depositing a large region is preferable.

In this embodiment, the dry-coating method is used as the method for depositing the transparent conductive film 12. Alternatively, a wet-coating method may be used.

The transparent conductive film 12 may have a substantially trapezoidal shape and formed to be slightly smaller than the contour of the substantially trapezoidal window sheet material 15. An upper side of the transparent conductive film 12 is substantially parallel to a lower side of the transparent conductive film 12 and shorter than the lower side of the transparent conductive film 12.

The left bus bar 13 is connected to a left edge of the transparent conductive film 12. The right bus bar 14 is connected to a right edge of the transparent conductive film 12. The left bus bar 13 and the right bus bar 14 are provided having the transparent conductive film 12 interposed therebetween for supplying electric power to the transparent conductive film 12. The left bus bar 13 and the right bus bar 14 are arranged in an inverted V-shape. The distance between the left bus bar 13 and the right bus bar 14 gradually becomes longer from the upper side of the transparent conductive film 12 to the lower side of the transparent conductive film 12.

Next, an opening pattern having multiple openings provided in the transparent conductive film 12 is described with reference to FIGS. 1 and 2. The term "vertical" refers to a direction that is substantially orthogonal to the upper side of the substantially trapezoidal transparent conductive film 12, and the term "horizontal" refers to a direction that is orthogonal to the vertical direction. The vertical direction and the horizontal direction are directions that are substantially parallel to the surface of the transparent conductive film 12 and that are alongside the surface of the transparent conductive film 12.

As illustrated in FIG. 1, the transparent conductive film 12 includes a band-shaped first region 21 interposed between the left bus bar 13 and the right bus bar 14 and a band-shaped second region 22 interposed between the left bus bar 13 and the right bus bar 14. A distance between the left bus bar 13 and the right bus bar 14 is shorter in the first region 21 than in the second region 22. The first region 21 may be positioned on an upper side to prevent the visibility of the driver of a vehicle from being obstructed, and the second region 22 may be a region besides such region. For example, the first region 21 is a region no greater than 500 mm downward from the upper side of the transparent conductive film 12, and preferably no greater than 400 mm, and more preferably no greater than 300 mm.

Because the first region 21 and the second region 22 are adjacent to each other, electric power is simultaneously supplied from a single left bus bar 13 and a single right bus bar 14, and substantially the same voltage is applied across the first and second regions 21, 22 from the upper side to the lower side. Electric current flows in each of the first region 21 and the second region 22.

Multiple openings 31 having vertical dimensions V greater than or equal to predetermined values are provided in the first region 21 for adjusting surface resistance. The multiple openings 31 may have the same shapes and same dimensions. The openings 31 are formed by using laser processing or the like and penetrating the transparent conductive film 12 in the thickness direction. The openings 31 may be vertically elongated and linearly shaped. Further, the openings 31 may be diagonally elongated and have vertical dimensions V greater than or equal to predetermined values.

The vertical dimension V is sufficient as long as an electric current path is extended to allow the electric current flowing in the first region 21 from one of the left and right bus bars 13, 14 to the other of the left and right bus bars 13, 14 can bypass the openings 31 in the vertical direction. That is, the vertical dimension V is sufficient as long as the length of the path for bypassing the electric current path of the electric current flowing in the first region 21 is set close to the length of the electric current path of the electric current flowing in the second region 22.

Although the vertical dimension V may be discretionally set according to the path length of the electric current flowing in the second region 22, it is preferable to be, for example, greater than or equal to 10 mm, more preferably greater than or equal to 15 mm, and yet more preferably greater than or equal to 20 mm and less than or equal to 100 mm.

The vertically elongated openings 31 are preferred to be formed in positions that does not come into the front view of the driver of the vehicle. As illustrated in FIG. 1, the openings 31 may be formed anywhere in the first region 21. In a case where the first region 21 comes into view of the driver looking at the front of the vehicle, the openings 31 may be formed at, for example, the left edge, the right edge, or both of the first region 21.

As illustrated in FIG. 2, the vertically elongated openings 31 may be arranged without any spaces in-between when viewed from the side. When viewed from the side, the multiple vertically elongated openings 31 may contact or overlap with each other. In any case, the openings 31 can prevent the current flowing in the first region 21 from horizontally advancing at a shortest distance from one of the left bus bar 13 and the right bus bar 14 to the other of the left bus bar 13 and the right bus bar 14.

The openings 31 may be arranged so that the current flowing in the first region 21 bypasses the openings 31 either upward or downward one or more times. The path of the current flowing in the first region 21 becomes longer and the difference with the path of the current flowing in the second region 22 becomes smaller. Therefore, the first region 21 and the second region 22 can be heated to the same degree. The term "bypass" means that electric current shifts upward and downward. The electric current may shift downward after shifting upward or shift upward after shifting downward. The "bypassing of the electric current one or more times" refers to the electric current shifting upward and downward at least once. The number of times of shifting upward and the number of times shifting downward may be the same or different.

Figure 18:
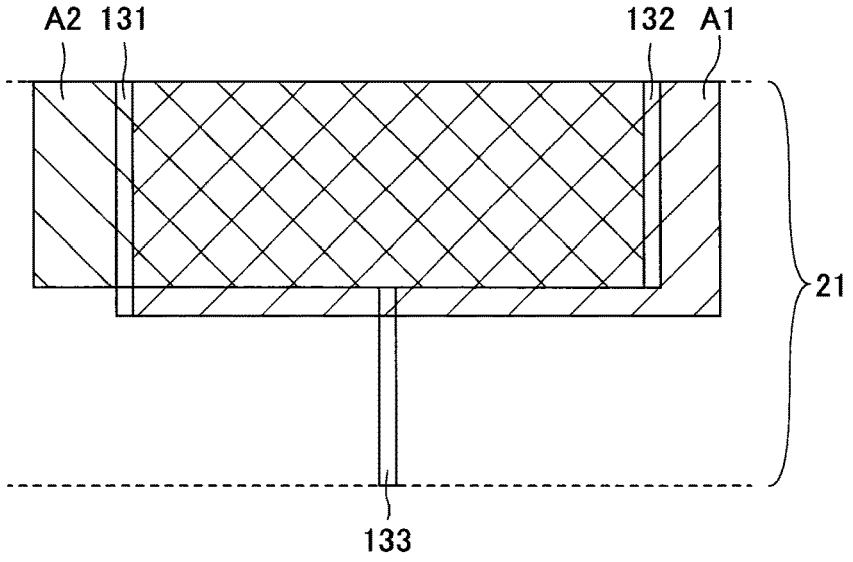
FIG. 18 is a schematic diagram for describing a positional relationship of openings.

Next, the arrangement of the openings that bypass the electric current path is described with reference to FIG. 18. The first region 21 of FIG. 18 includes a first opening 131, a second opening 132, and a third opening 133. The first opening 131 and the second opening 132 are arranged to be spaced apart from each other in the horizontal direction. Further, the third opening 133 partly overlaps with an extended region A1 (region indicated with diagonal lines slanted toward the lower left in FIG. 18) that extends from the first opening 131 to the second opening 132 in the horizontal direction. Therefore, first, the path of the electric current flowing from left to right toward the first opening 131 in the first region 21 is blocked by the first opening 131 and shifts downward. Then, the path of the electric current is blocked by the third opening 133 and shifts upward. Further, the third opening 133 contacts an extended region A2 (region indicated with diagonal lines slanted toward the lower right in FIG. 18) that extends from the second opening 132 to the first opening 131 in the horizontal direction. Therefore, after the path of the electric current is blocked by the third openings and shifts upward, the path of the electric current is blocked by the second opening 132 and shifts downward. Therefore, the path of the electric current flowing in the first region 21 vertically bypasses the first opening 131, the second opening 132, and the third opening 133 at least once.

The openings that bypass the electric current path may be arranged in various ways. For example, another opening(s) may be provided between the first opening 131 and the second opening 132 arranged adjacent to each other in the horizontal direction. Further, the third opening 133 may contact the extended region A1 and partly overlap with the extended region A2. The third opening 133 extends in a direction separating from both the extended region A1 and the extended region A2.

Next, the arrangement of the openings that bypass the electric current path is described with reference to FIG. 2. The first region 21 illustrated in FIG. 2 includes first and second openings 31-1 that form a first row and a third opening 31-2 that forms a second row. The upper end of the third opening 31-2 contacts a region extending from the first opening 31-1 to the second opening 31-1 in the horizontal direction and a region extending from the second opening 31-1 to the first opening 31-1 in the horizontal direction, respectively. First, the path of the electric current flowing in the horizontal direction to the first opening 31-1 of the first row is blocked by the opening 31-1 of the first row and shifts downward. Then, the path of the electric current is blocked by the opening 31-2 of the second row and shifts upward. Further, the path of the electric current flowing in the horizontal direction to the third opening 31-2 of the second row is blocked by the opening 31-2 of the second row and shifts upward. Then, the path of the electric current is blocked by the opening 31-1 of the first row and shifts downward. Therefore, the path of the electric current flowing in the first region 21 is vertically bypassed at least once by the first opening 31-1, the second opening 31-1, and the third opening 31-2.

As illustrated in FIG. 2, multiple openings 31 includes the first row having openings 31-1 arranged in the horizontal direction and the second row having openings 31-2 arranged in the horizontal direction at positions shifted vertically and horizontally from the openings 31-1 of the first row. Although multiple openings are provided in each row, a single opening may be provided in either one of the rows.

The positions being shifted vertically and horizontally from the openings refers to shifting positions from the openings, serving as the benchmark, in the direction in which electric current flows between the bus bars, that is, the horizontal direction, and further, in the direction orthogonal to the direction in which electric current flows, that is, the vertical direction. For example, the positions shifted in vertical and horizontal directions from each of the openings 31-1 of the first row include a position shifted in the horizontal direction from the space between each of the openings 31-1 of the first row and each of the openings 31-3 of the third row. In a case where there is only a single opening in a target row, the positions shifted in vertical and horizontal directions include a position shifted in a horizontal direction from regions contacting both vertical ends of the single opening. Each of the openings 31-1 of the first row and each of the openings 31-2 of the second row may be arranged, so that the current flowing between the bus bars vertically staggers by bypassing each of the openings 31. The path of the electric current flowing in the first region 21 easily becomes long. Similarly, multiple openings 31-3 horizontally provided in the third row may be arranged to be shifted vertically and horizontally with respect to each of the openings 31-2 of the second row. Similarly, fourth and fifth rows may be provided. In the embodiment of FIG. 2, a line connecting the lower ends of the openings 31-1 of the first row and a line connecting the upper ends of the openings 31-2 of the second row are matched. Alternatively, the line connecting the upper ends of the openings 31-2 of the second row may be above the line connecting the line connecting the lower ends of the openings 31-1 of the first row. The same may apply to the second row and the third row.

In the first region 21, openings 31 having vertical dimensions V greater than or equal to predetermined values may be arranged in a staggered manner in the horizontal direction as illustrated in FIG. 2. The intervals of the change of electric current becomes shorter and the path of the electric current easily becomes long.

In a case where the transparent conductive film 12 is provided in the window sheet material 15 as in this embodiment, electromagnetic waves are blocked by the second region 22 of the transparent conductive film 12. That is, because the second region 22 prevents electromagnetic waves from permeating through a vehicle, the electromagnetic waves of devices required to communicate with the outside of the vehicle are blocked.

However, with the first region 21 of this embodiment, electromagnetic waves of a predetermined frequency can be transmitted by providing vertically elongated openings 31 as illustrated in FIG. 2. More specifically, an electromagnetic wave of a predetermined frequency having a horizontally polarized wave plane and corresponding to the length of the vertical dimension V is can be transmitted, and the first region 21 can function as a frequency selective surface.

In this embodiment, it is preferable that the vertical dimension V of the opening 31 is greater than or equal to "$(1/2)\cdot\lambda_{g1}$" in a case where the atmospheric wavelength of a center frequency of a predetermined frequency band of a horizontally polarized electromagnetic wave to be transmitted is "$\lambda_{01}$", "k" is a shortening coefficient of wavelength by the electrically-heated window sheet material 10, and the wavelength of the electrically-heated window sheet material 10 is "$\lambda_{g1}=\lambda_0\cdot k$". In a case where the electrically-heated window sheet material 10 is a laminated glass having two glass sheets laminated interposed by an intermediate film formed of polyvinyl butyral, the shortening coefficient of wavelength "k" is approximately 0.51. For example, in a case where the predetermined frequency desired to be transmitted is 2.4 GHz, it is preferable that the vertical dimension V is greater than or equal to approximately 32 mm.

Figure 3:
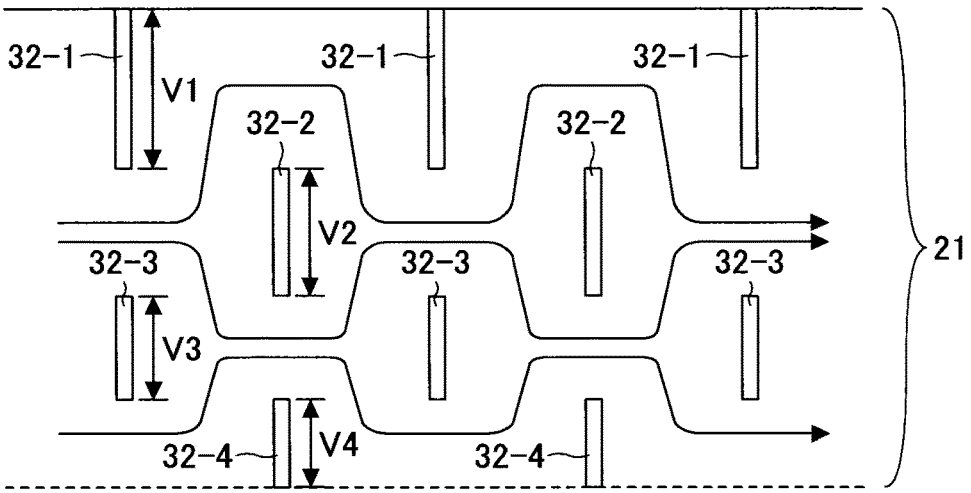
FIG. 3 is a schematic diagram illustrating an opening pattern of a transparent conductive film according to a first modified example.

Next, an opening pattern of multiple openings of a transparent conductive film according to a first modified example is described with reference to FIG. 3. The arrows in FIG. 3 indicate paths of electric current. The paths of electric current are illustrated for the sake of convenience and are not necessarily accurate. Similar to the above-described embodiment, the modified example also has multiple vertically elongated openings 32-1~32-4 arranged in the first region 21 in a staggered manner in the horizontal direction.

As illustrated in FIG. 1, the distance between the left bus bar 13 and the right bus bar 14 gradually becomes longer from the upper to lower side of the first region 21.

In this modified example, the vertical dimensions V1~V4 of the vertically elongated openings 32-1~32-4 become smaller toward the lower side (V1>V2>V3>V4) unlike those of the above-described embodiment. That is, the vertical dimensions V2 of the openings 32-2 of the second row are smaller than the vertical dimensions V1 of the openings 32-1 of the first row. Similarly, the vertical dimensions V3 of the openings 32-3 of the third row are smaller than the vertical dimensions V2 of the openings 32-2 of the second row, and the vertical dimensions V4 of the openings 32-4 of the fourth row are smaller than the vertical dimensions V3 of the openings 32-3 of the third row. Therefore, the meandering width of each current flowing in the first region 21 becomes narrower toward the lower side. Accordingly, a large portion of the current paths in the first region can have the same lengths so that the first region 21 can be uniformly heated.

Figure 4:
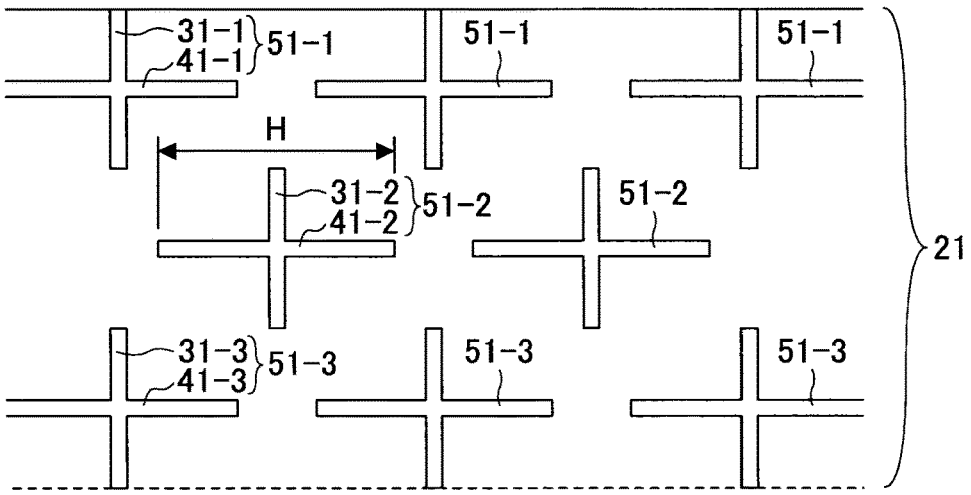
FIG. 4 is a schematic diagram illustrating an opening pattern of a transparent conductive film according to a second modified example.

Next, an opening pattern of multiple openings of a transparent conductive film according to a second modified example is described with reference to FIG. 4. Similar to the above-described embodiment, this modified example has multiple vertically elongated openings 31 having the same shapes and dimensions and being arranged in the first region 21 in a staggered manner in the vertical and horizontal directions.

In this modified example, horizontal openings 41 having horizontal dimensions H greater than or equal to predetermined values are provided in the first region 21 unlike those of the above-described embodiment. The horizontal openings 41 may be elongated in a horizontal direction and have linear shapes. Because the first region 21 of the above-described embodiment has vertically elongated openings 31, the first region 21 may be a frequency selective surface that allows horizontally polarized electromagnetic waves to be transmitted as described above. The first region 21 of this modified example not only has vertically elongated openings 31 but also has horizontally elongated horizontal openings 41. Thus, the first region 21 allows vertically polarized electromagnetic waves of a predetermined frequency to be transmitted, so that the first region 21 functions as a frequency selective surface that allows vertically polarized electromagnetic waves to be transmitted. The polarized plane of electromagnetic waves of mobile phones or the like tends to be vertical. Thus, the first region 21 can allow vertically polarized electromagnetic waves to be transmitted.

In this case, it is preferable that the horizontal dimension H of the opening 41 is greater than or equal to "$(1/2)\cdot\lambda_g$" in a case where the atmospheric wavelength of a center frequency of a predetermined frequency band of a horizontally polarized electromagnetic wave to be transmitted is "$\lambda_0$", "k" is a shortening coefficient of wavelength by the electrically-heated window sheet material 10, and the wavelength of the electrically-heated window sheet material 10 is "$\lambda_g=\lambda_0\cdot k$". For example, in a case where the predetermined frequency desired to be transmitted is 900 MHz, it is preferable that the horizontal dimension H is greater than or equal to approximately 85 mm when the shortening coefficient of wavelength is 0.51. Further, in a case where the predetermined frequency desired to be transmitted is 1.9 GHz, it is preferable that the horizontal dimension H is greater than or equal to 40 mm.

The multiple horizontally elongated horizontal openings 41 have the same shapes and dimensions and are arranged in the first region 21 in a staggered manner in the horizontal direction.

Further, multiple cross openings 51 having the vertically elongated openings 31 and the horizontally elongated horizontal openings 41 intersecting in a cross are arranged in the first region 21 of this modified example. As illustrated in FIG. 4, the multiple cross openings 51 include a first row having cross openings 51-1 arranged in the horizontal direction and a second row having cross openings 51-2 arranged in the horizontal direction and being shifted vertically and horizontally from the cross openings 51-1 of the first row. The multiple cross openings 51 may also include a third row having cross openings 51-3 arranged in the horizontal direction and being shifted vertically and horizontally from the cross openings 51-2 of the second row. Because the cross openings 51-1~51-3 having the same shapes and dimensions are arranged in a staggered manner, cross openings 51 are pleasant to the eye.

Figure 5:
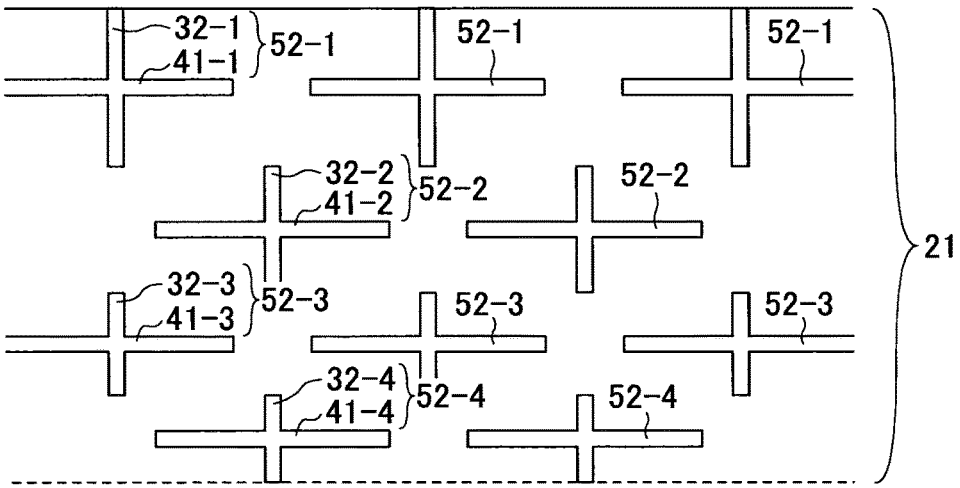
FIG. 5 is a schematic diagram illustrating an opening pattern of a transparent conductive film according to a third modified example.

Next, an opening pattern of multiple openings of a transparent conductive film according to a third modified example is described with reference to FIG. 5. Similar to the first modified example, the third modified example also has multiple vertically elongated openings 32-1~32-4 arranged in the first region 21 in a staggered manner in the horizontal direction. The dimensions of the vertically elongated openings 32-1~32-4 become smaller toward the lower side.

Similar to the second modified example, this modified example also has horizontally elongated horizontal openings 41 provided in the first region 21. Multiple cross openings 52-1~52-4 having the vertically elongated openings 32-1~32-4 and the horizontally elongated horizontal openings 41-1~41-4 intersecting in a cross are arranged in the first region 21. The cross openings 52-1 that are arranged in the horizontal direction form a first row, the cross openings 52-2 that are arranged in the horizontal direction form a second row, the cross openings 52-3 that are arranged in the horizontal direction form a third row, and the cross openings 52-4 that are arranged in the horizontal direction form a fourth row. By forming the first region 21 in this manner, this modified example can attain the same effects as those attained by the first and second modified examples.

Figure 6:
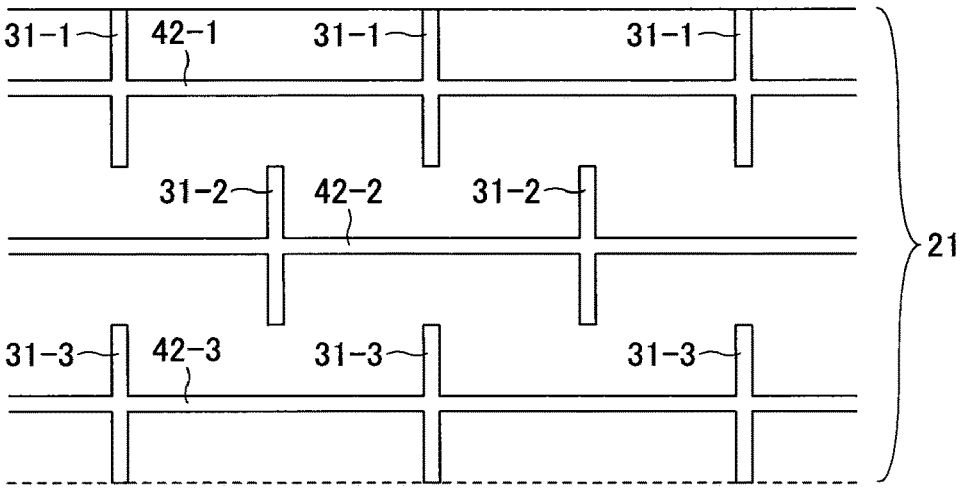
FIG. 6 is a schematic diagram illustrating an opening pattern of a transparent conductive film according to a fourth modified example.

Next, an opening pattern of multiple openings of a transparent conductive film according to a fourth modified example is described with reference to FIG. 6. Similar to the second modified example, this modified example has multiple vertically elongated openings 31-1~31-3 having the same shapes and dimensions and being arranged in the first region 21 in a staggered manner in the horizontal direction. The multiple openings 31-1 that are arranged in the horizontal direction form a first row, the multiple openings 31-2 that are arranged in the horizontal direction form a second row, and the multiple openings 31-3 that are arranged in the horizontal direction form a third row. Further, horizontal openings 42-1~42-3 that have horizontal dimensions greater than or equal to predetermined values are provided in the first region 21. The horizontal openings 42-1~42-3 may be elongated in the horizontal direction and have linear shapes. By providing the horizontally elongated horizontal openings 42, electromagnetic waves having vertically polarized waves of a predetermined frequency are allowed to be transmitted, so that the first region 21 functions as a frequency selective surface that allows vertically polarized electromagnetic waves to be transmitted. The multiple horizontally elongated horizontal openings 42 have the same shapes and dimensions.

Unlike the second modified example, the horizontal openings 42 of this modified example intersect the multiple vertically elongated openings 31 at spaced-intervals in the horizontal directions. By providing the horizontal openings 42 that have sufficiently large horizontal dimensions, the frequency range of the vertically polarized electromagnetic wave can be broadened. The horizontal openings 42 may be provided throughout the entire region where the vertically elongated openings 31 are formed, so that the horizontal openings 42 may extend from a left edge to the right edge of the first region 21.

Figure 7:
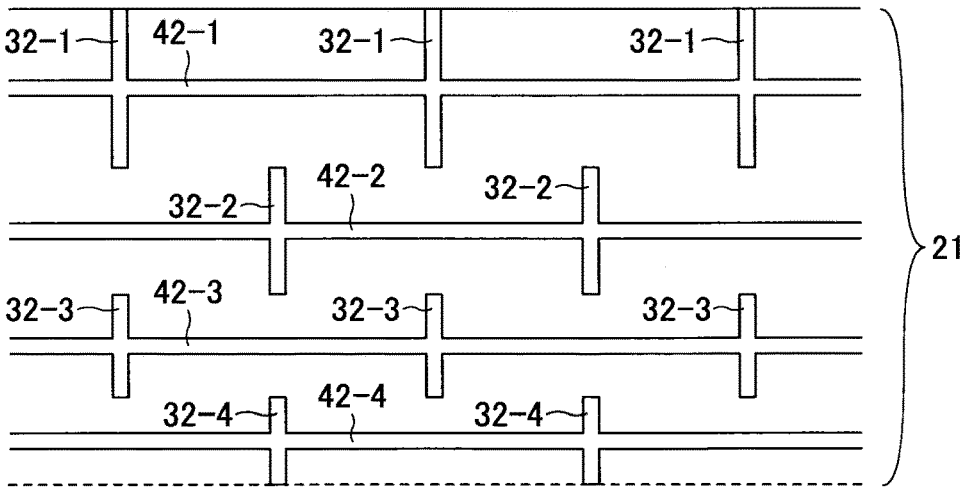
FIG. 7 is a schematic diagram illustrating an opening pattern of a transparent conductive film according to a fifth modified example.

Next, an opening pattern of multiple openings of a transparent conductive film according to the fifth modified example is described with reference to FIG. 7. Similar to the third modified example, multiple vertically elongated openings 32-1~32-4 of this embodiment are arranged in the first region 21 in a staggered manner in the horizontal direction. The multiple openings 32-1 that are arranged in the horizontal direction form a first row, the multiple openings 32-2 that are arranged in the horizontal direction form a second row, the multiple openings 32-3 that are arranged in the horizontal direction form a third row, and the multiple openings 32-4 that are arranged in the horizontal direction form a fourth row. The dimensions of the vertically elongated openings 32-1~32-4 become smaller toward the lower side. Further, the horizontally elongated openings 42-1~42-4 are provided in the first region 21.

Unlike the third modified example but similar to the fourth modified example, this modified example has horizontal openings 42 (for example, horizontal opening 42-1) each of which intersecting multiple vertically elongated openings 32 (for example, opening part 32-1) arranged at spaced-intervals in the horizontal direction. The horizontal openings 42 may be provided to extend throughout the entire region where the vertically elongated openings 32 are formed. The horizontal openings 42 may be provided to extend from one side part of the first region 21 to the other side part of the first region 21. By forming the first region 21 in this manner, this modified example can attain the same effects as those attained by the first and fourth modified examples.

Figure 8:
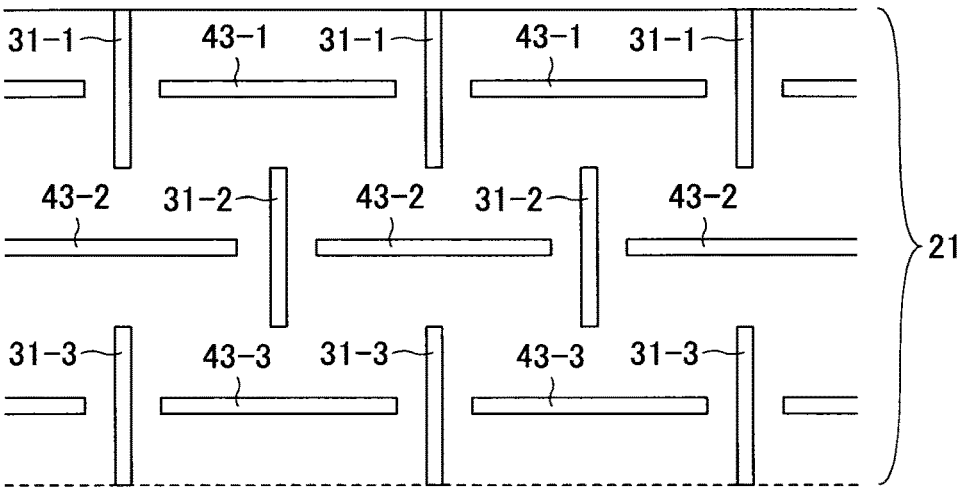
FIG. 8 is a schematic diagram illustrating an opening pattern of a transparent conductive film according to a sixth modified example.

Next, an opening pattern of multiple openings of a transparent conductive film according to a sixth modified example is described with reference to FIG. 8. Similar to the second modified example, this modified example also has multiple vertically elongated openings 31-1~31-3 having the same shapes and dimensions and being arranged in the first region 21 in a staggered manner in the horizontal direction. The multiple openings 31-1 that are arranged in the horizontal direction form a first row, the multiple openings 31-2 that are arranged in the horizontal direction form a second row, and the multiple openings 31-3 that are arranged in the horizontal direction form a third row. Further, horizontal openings 43-1~43-3 that have horizontal dimension greater than or equal to predetermined values are provided in the first region 21. The horizontal openings 43-1~43-3 may be elongated in the horizontal direction and have linear shapes. The multiple horizontally elongated horizontal openings 43-1~43-3 may have the same shapes and dimensions and be arranged in the first region 21 in a staggered manner in the horizontal direction. Each of the horizontal openings 43-1 adjacently arranged in the horizontal direction is positioned between vertically elongated openings 31-1, each of the horizontal openings 43-2 adjacently arranged in the horizontal direction is positioned between vertically elongated openings 31-2, and each of the horizontal openings 43-3 adjacently arranged in the horizontal direction is positioned between vertically elongated openings 31-3.

Unlike the second modified example, the vertically elongated openings 31 and the horizontally elongated horizontal openings 43 of this modified example are spaced apart from each other and do not intersect. However, because this modified example is provided with horizontal openings 43 having horizontal dimensions greater than or equal to predetermined values, electromagnetic waves having vertically polarized waves of a predetermined frequency are allowed to be transmitted similar to those of the second modified example, so that the first region 21 functions as a frequency selective surface that allows vertically polarized electromagnetic waves to be transmitted. Because vertically elongated openings 31 having the same shapes and dimensions and horizontally elongated horizontal openings 43 having the same shapes and dimensions are orderly arranged, vertically elongated openings 31 and the horizontal openings 43 are pleasant to the eye.

Figure 9:
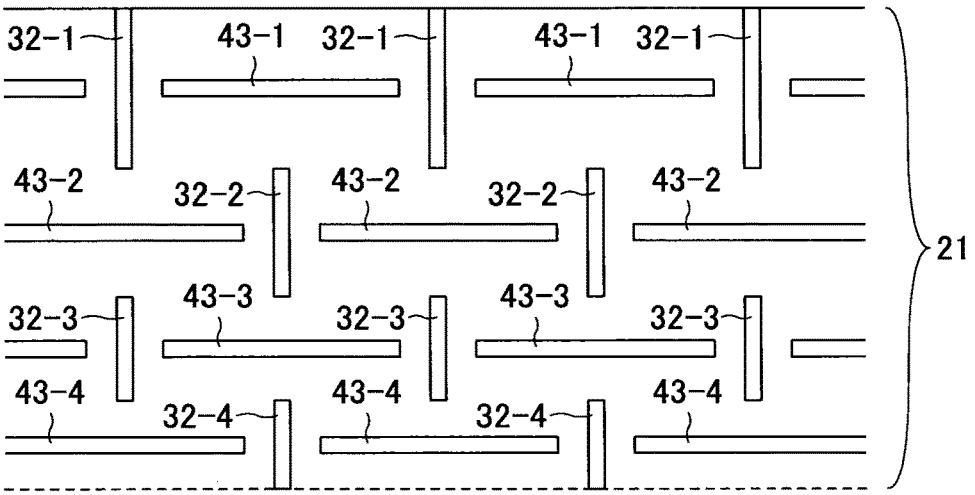
FIG. 9 is a schematic diagram illustrating an opening pattern of a transparent conductive film according to a seventh modified example.

Next, an opening pattern of multiple openings of a transparent conductive film according to a seventh modified example is described with reference to FIG. 9. Similar to the third modified example, this modified example has multiple vertically elongated openings 32-1~32-4 arranged in the first region 21 in a staggered manner in the horizontal direction. The multiple openings 32-1 that are arranged in the horizontal direction form a first row, the multiple openings 32-2 that are arranged in the horizontal direction form a second row, the multiple openings 32-3 that are arranged in the horizontal direction form a third row, and the multiple openings 32-4 that are arranged in the horizontal direction form a fourth row. Further, the vertical dimensions of the vertically elongated openings 32-1~32-4 become smaller toward the lower side. Further, horizontally elongated horizontal openings 43-1~43-4 are provided in the first region 21. Further, each of the horizontal openings 43-1 adjacently arranged in the horizontal direction is positioned between vertically elongated openings 32-1, each of the horizontal openings 43-2 adjacently arranged in the horizontal direction is positioned between vertically elongated openings 32-2, and each of the horizontal openings 43-3 adjacently arranged in the horizontal direction is positioned between vertically elongated openings 32-3, and each of the horizontal openings 43-4 adjacently arranged in the horizontal direction is positioned between vertically elongated openings 32-4.

Unlike the third modified example but similar to the sixth modified example, the vertically elongated openings 32 and the horizontally elongated horizontal openings 43 of this modified example are spaced apart from each other and do not intersect. By forming the first region 21 in this manner, this modified example can attain the same effects as those attained by the first and sixth modified examples.

Figure 10:
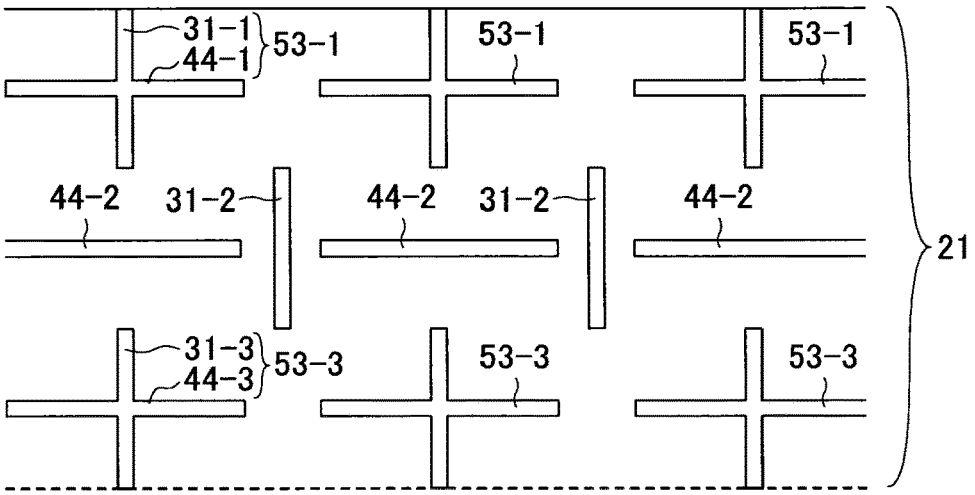
FIG. 10 is a schematic diagram illustrating an opening pattern of a transparent conductive film according to an eighth modified example.

Next, an opening pattern of multiple openings of a transparent conductive film according to an eighth modified example is described with reference to FIG. 10. Similar to the second modified example, multiple vertically elongated openings 31 of this modified example have the same shapes and dimensions and arranged in the first region 21 in a staggered manner in the horizontal direction. Multiple openings 31-1 that are arranged in the horizontal direction form a first row, multiple openings 31-2 that are arranged in the horizontal direction form a second row, and multiple openings 31-3 that are arranged in the horizontal direction form a third row. Further, horizontal openings 44-1~44-3 having horizontal dimensions greater than or equal to predetermined values are provided in the first region 21. The horizontal openings 44-1~44-3 may be elongated in the horizontal direction and have linear shapes. The multiple horizontal openings 44-1~44-3 have the same shapes and dimensions.

Unlike the second modified example, the multiple horizontally elongated horizontal openings 44-1~44-3 of this modified example are arranged in vertical and horizontal directions. Among the multiple horizontal openings 44, portions thereof 44-1, 44-3 intersect the vertically elongated openings 31 (openings 31-1, 31-3) whereas remaining portions thereof 44-2 are spaced apart from the vertically elongated openings 31 (openings 31-2). That is, the openings 31-1 of the first row and the openings 31-3 of the third row form cross openings 53-1, 53-3 by intersecting the horizontal openings 44 whereas the openings 31-2 of the second row are spaced apart from the horizontal openings 44-2. By forming the first region 21 in this manner, this modified example can attain the same effects as those attained by the second and sixth modified examples.

Figure 11:
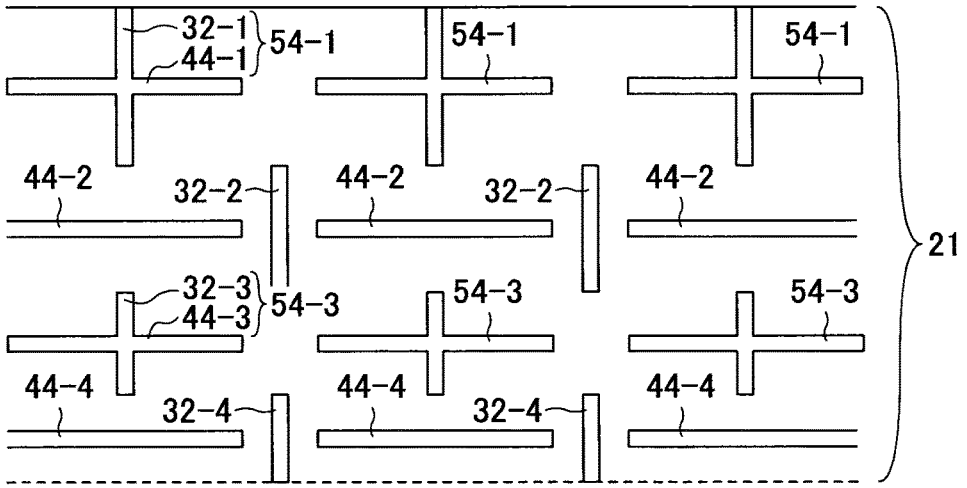
FIG. 11 is a schematic diagram illustrating an opening pattern of a transparent conductive film according to a ninth modified example.

Next, an opening pattern of multiple openings of a transparent conductive film according to a ninth modified example is described with reference to FIG. 11. Similar to the third modified example, this modified example has multiple vertically elongated openings 32-1~32-4 arranged in the first region 21 in a staggered manner in the horizontal direction. The multiple openings 32-1 that are arranged in the horizontal direction form a first row, the multiple openings 32-2 that are arranged in the horizontal direction form a second row, the multiple openings 32-3 that are arranged in the horizontal direction form a third row, and the multiple openings 32-4 that are arranged in the horizontal direction form a fourth row. Further, the vertical dimensions of the vertically elongated openings 32-1~32-4 become smaller toward the lower side. Further, horizontally elongated horizontal openings 44-1~44-4 are provided in the first region 21.

Unlike the third modified example but similar to the eighth modified example, this modified example has multiple horizontally elongated horizontal openings 44 arranged in vertical and horizontal directions. Among the multiple horizontal openings 44, portions thereof 44-1, 44-3 intersect the vertically elongated openings 32 (openings 32-1, 32-3) to form cross openings 54 (cross openings 54-1, 54-3) whereas remaining portions thereof 44-2, 44-4 are spaced apart from the vertically elongated openings 32 (openings 32-2, 32-4). By forming the first region 21 in this manner, this modified example can attain the same effects as those attained by the first and eighth modified examples.

Figure 12:
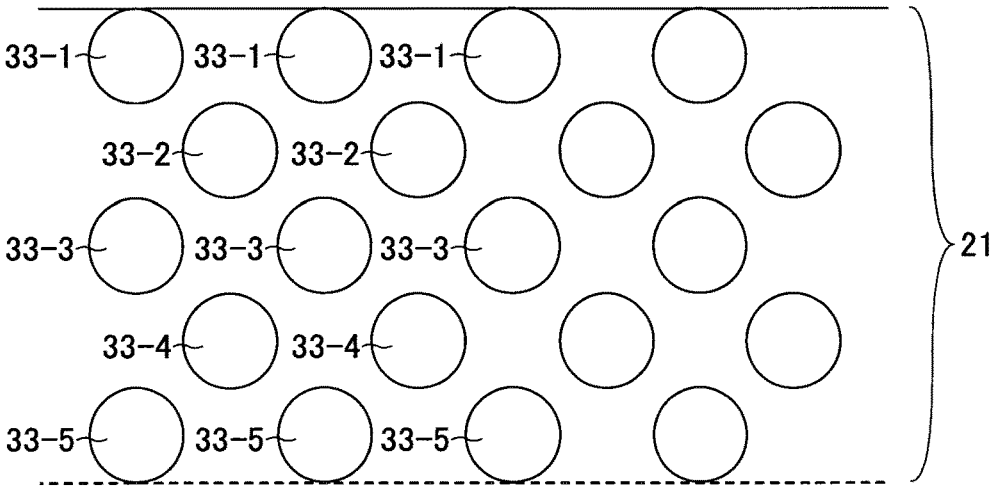
FIG. 12 is a schematic diagram illustrating an opening pattern of a transparent conductive film according to a tenth modified example.

Next, an opening pattern of multiple openings of a transparent conductive film according to a tenth modified example is described with reference to FIG. 12. Similar to the above-described embodiment, the openings 33 of this modified example having vertical dimensions greater than or equal to predetermined values are provided in the first region 21. The multiple openings 33-1 that are arranged in the horizontal direction form a first row, the multiple openings 33-2 that are arranged in the horizontal direction form a second row, the multiple openings 33-3 that are arranged in the horizontal direction form a third row, the multiple openings 33-4 that are arranged in the horizontal direction form a fourth row, and the multiple openings 33-5 that are arranged in the horizontal direction form a fifth row.

Unlike the above-described embodiment, the openings 33 of this modified example having vertical dimensions greater than or equal to predetermined values do not have linear shapes but have circular shapes. The vertical dimensions of the circular openings 33 and the horizontal dimensions of the circular openings 33 are the same. Although the shapes of the openings 33 of this modified example are circular, the shapes of the openings 33 may be elliptical shapes or polygonal shapes such as square shapes or rectangular shapes. By forming the multiple openings having vertical dimensions greater than or equal to predetermined values and horizontal dimensions greater than or equal to predetermined values, this modified example can attain the same effects as those attained by the second modified example.

Figure 13:
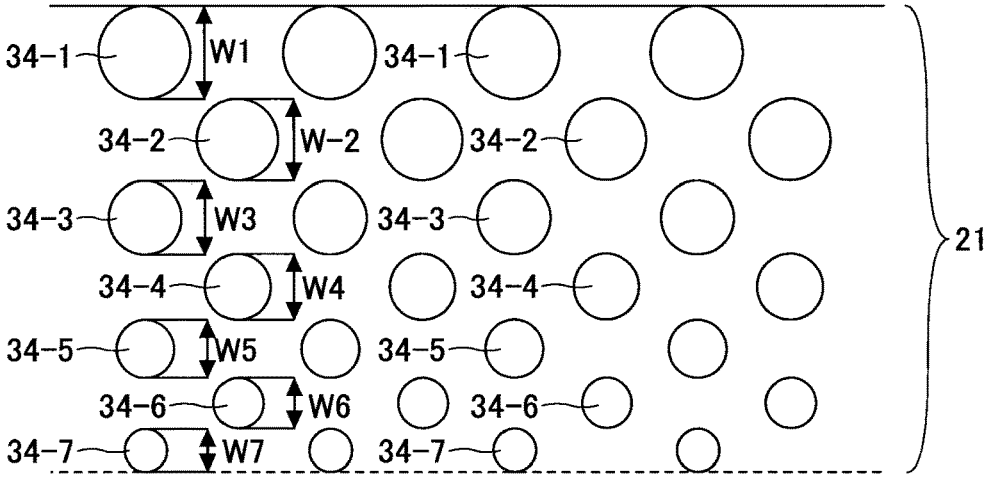
FIG. 13 is a schematic diagram illustrating an opening pattern of a transparent conductive film according to an eleventh modified example.

Next, an opening pattern of multiple patterns of a transparent conductive film according to an eleventh modified example is described with reference to FIG. 13. Similar to the first and tenth modified examples, multiple circular openings 34-1~34-7 having horizontal dimensions greater than or equal to predetermined values and vertical dimensions greater than or equal to predetermined values are provided in the first region 21. Further, the vertical dimensions W1~W7 of the openings 34-1~34-7 become smaller toward the lower side (W1>W2>W3>W4>W5>W6>W7).

Unlike the first modified example but similar to the tenth modified example, the openings 34-1~34-7 of this modified example having vertical dimensions greater than or equal to predetermined dimensions do not have linear shapes but have circular shapes. The vertical dimensions of the circular openings 33 and the horizontal dimensions of the circular openings 33 are the same. Although the shapes of the openings 34-1~34-7 of this modified example are circular, the shapes of the openings 34-1~34-7 may be elliptical shapes or polygonal shapes such as square shapes or rectangular shapes. By forming the first region 21 in this manner, this modified example can attain the same effects as those attained by the first and tenth modified examples.

Practical Example

[First~Fourth Samples]

In the first to fourth samples, electromagnetic field simulation using a FDTD (Finite Difference Time Domain) method is performed to analyze the transmission property of vertically polarized electromagnetic waves with respect to laminated glass having transparent conductive films.

With the first to fourth samples, the analysis is performed under the same conditions except for changing the opening patterns of the multiple openings of the transparent conductive films. The laminated glass includes a glass sheet, an intermediate film, a transparent conductive film, an intermediate film, and a glass sheet in this order. The vertically polarized wave is incident on the laminated glass in its thickness direction. Among the four sides of the transparent magnetic film having a rectangular shape (width 300 mm×height 200 mm), a magnetic wall is set as a boundary condition for the upper and lower sides and an electric wall is set as a boundary condition for the left and right sides. The frequency of the electromagnetic wave that is to be transmitted is changed from 0 GHz to 3 GHz.

The model of the laminated glass in the electromagnetic simulation is set as follows.

Thickness of each glass sheet: 2.0 mm

Thickness of each intermediate film: 0.381 mm

Thickness of transparent conductive film: 0.01 mm

Relative permittivity of each glass sheet: 7.0

Relative permittivity of each intermediate film: 3.0

Resistance of transparent conductive film: 1.0Ω

Figure 14:
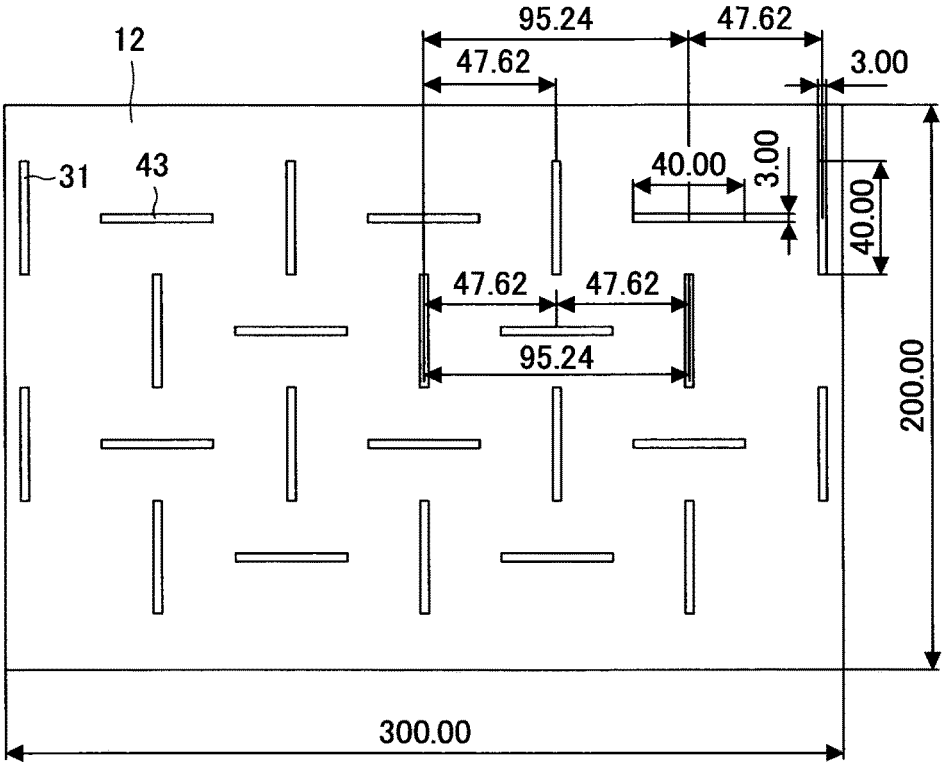
FIG. 14 is a schematic diagram illustrating an opening pattern of a transparent conductive film according to a first sample.

FIG. 14 is a schematic diagram illustrating an opening pattern of multiple openings of a transparent conductive film according to the first sample. In FIG. 14, reference numeral 12 indicates a transparent conductive film, reference numeral 31 indicates a vertically elongated opening, reference numeral 43 indicates a horizontally elongated opening, and the other numerals indicate the dimensions of the opening pattern (mm). Because the opening pattern of the first sample is similar to the opening pattern of the sixth modified example (see FIG. 8), further description thereof is omitted.

Figure 15:
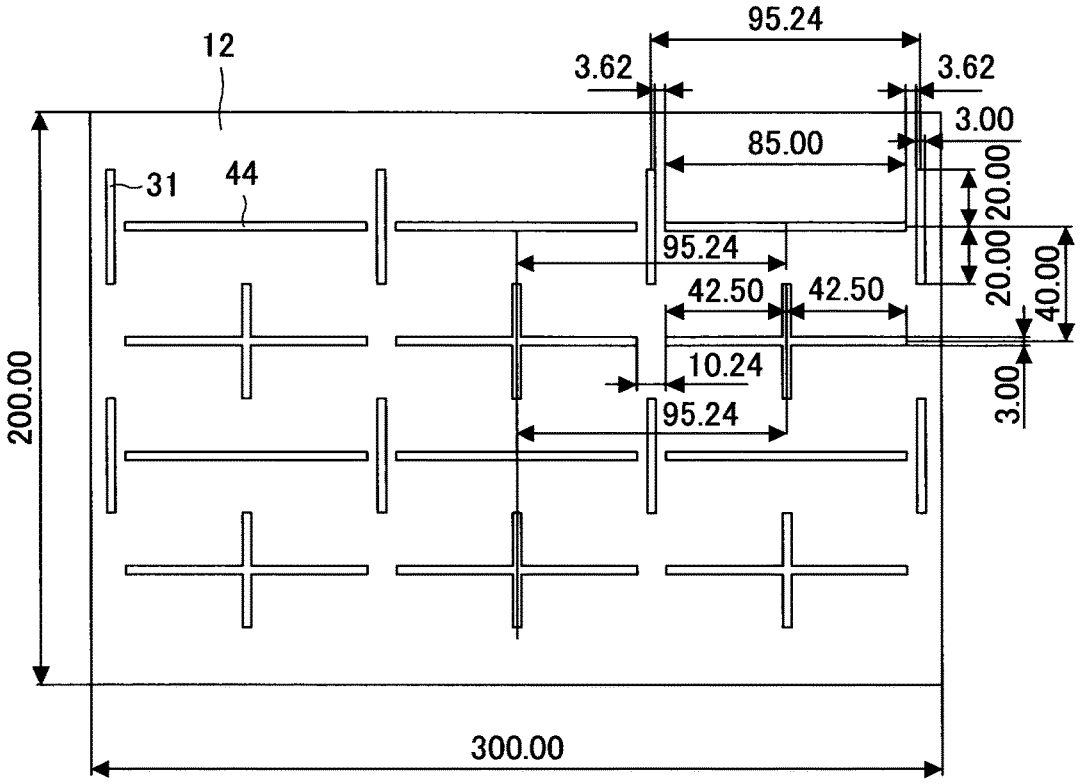
FIG. 15 is a schematic diagram illustrating an opening pattern of a transparent conductive film according to a second sample.

FIG. 15 is a schematic diagram illustrating an opening pattern of multiple openings of a transparent conductive film according to the second sample. In FIG. 15, reference numeral 12 indicates a transparent conductive film, reference numeral 31 indicates a vertically elongated opening, reference numeral 44 indicates a horizontally elongated opening, and the other numerals indicate the dimensions of the opening pattern (mm). Because the opening pattern of the second sample is similar to the opening pattern of the eighth modified example (see FIG. 10), further description thereof is omitted.

Figure 16:
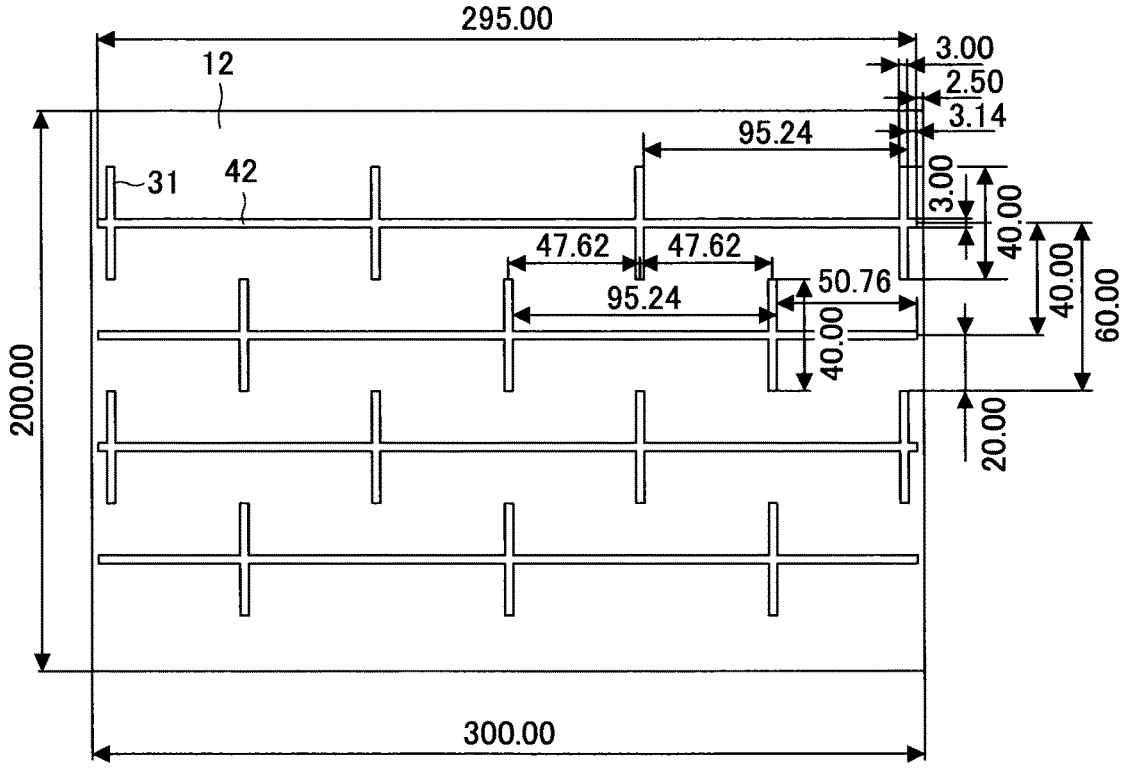
FIG. 16 is a schematic diagram illustrating an opening pattern of a transparent conductive film according to a third sample.

FIG. 16 is a schematic diagram illustrating an opening pattern of multiple openings of a transparent conductive film according to the third sample. In FIG. 16, reference numeral 12 indicates a transparent conductive film, reference numeral 31 indicates a vertically elongated opening, reference numeral 42 indicates a horizontally elongated opening, and the other numerals indicate the dimensions of the opening pattern (mm). Because the opening pattern of the third sample is similar to the opening pattern of the fourth modified example (see FIG. 6), further description thereof is omitted.

The fourth sample is a comparative example using a transparent conductive film without any openings. Thus, an illustration thereof is omitted.

Figure 17:
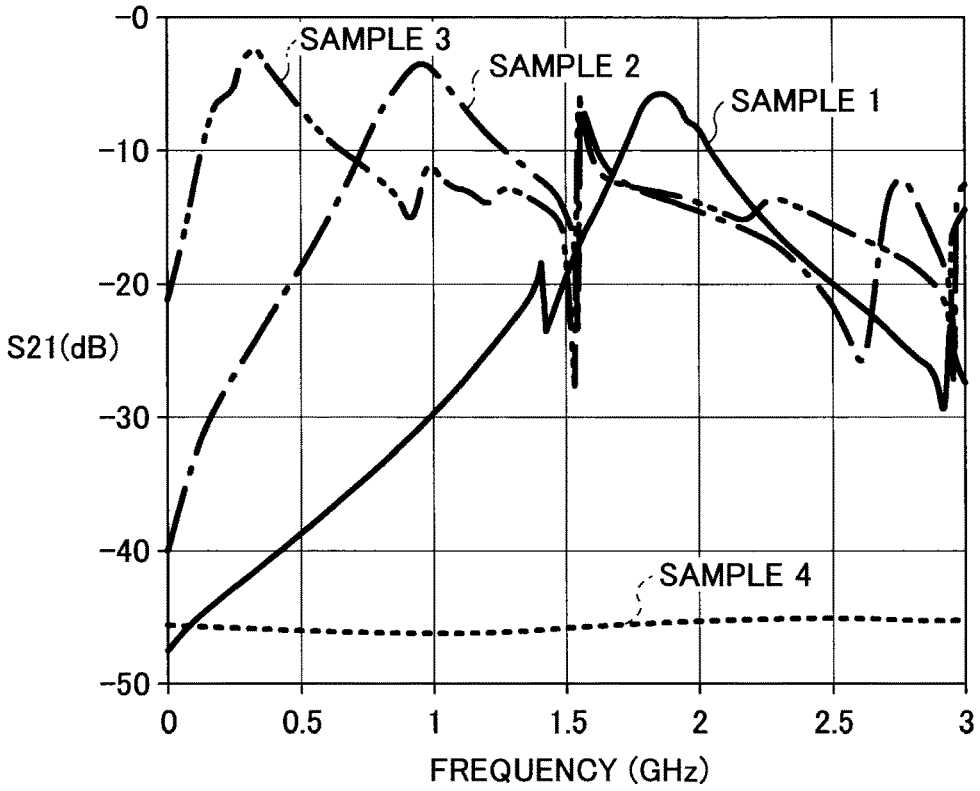
FIG. 17 is a graph illustrating a transmission property of electromagnetic waves according to the first-fourth samples.

FIG. 17 is a graph illustrating transmission property of a vertically polarized wave with respect to laminated glass including the transparent conductive films of the first to fourth samples. In FIG. 17, the solid line indicates an analysis result of the first sample, a dot-chained line indicates an analysis result of the second sample, a double-dot chained line indicates an analysis result of the third sample, and a broken line indicates an analysis result of the fourth example. The horizontal axis of FIG. 17 corresponds to a frequency (GHz) of a vertically polarized wave that is to be transmitted, and the vertical axis of FIG. 17 corresponds to transmission loss S21 (dB) of the incident vertically polarized wave.

As shown in FIG. 17, it can be understood that the first to third samples allow vertically polarized waves to be transmitted through the transparent conductive films more easily compared to the fourth sample because horizontally elongated openings are provided. Further, it can be understood that the frequency dependency of the vertically polarized waves change according to the dimensions and arrangement of the horizontally elongated openings.

[Fifth to Seventh Samples]

In the fifth to seventh samples, heat generation simulation is performed to analyze the temperature distribution when voltage is applied to laminated glass. The fifth and sixth samples are practical examples whereas the seventh sample is a comparative example.

For simplifying the analysis, the laminated glass includes a glass sheet, a transparent conductive film, and a glass sheet in this order and does not include an intermediate film. The dimensions and physical characteristics of each of the elements are as follows.

Thickness of each glass sheet: 2.0 mm

Thermal conductivity of each glass sheet: 1.0 W/(m·K)

Specific heat of each glass sheet: 670 J/(kg·K)

Mass density of each glass sheet: 2.2 g/cm$^3$

Thickness of transparent conductive film: 0.002 mm

Electric conductivity of transparent conductive film: 625000 $\Omega^{-1}\cdot m^{-1}$ Thermal conductivity of transparent conductive film: 420 W/(m·K)

Specific heat of transparent conductive film: 235 J/(kg·K)

Mass density of each transparent conductive film: 1.07 g/cm$^3$

The finite-element analysis model of the laminated glass is fabricated by using software "HyperMesh" manufactured by Altair Engineering Ltd. The temperature distribution of the model when voltage is applied between the bus bars is obtained by using software "Abaqus/Standard" which is a general-purpose finite-element analysis program manufactured by Dassault Systems Corp.

The initial temperature of the laminated glass is 23° C., and a heat transfer boundary condition is set to a boundary between the laminated glass and the air. The heat transfer boundary condition refers to a boundary condition in which heat transfer is performed between the laminated glass and the air. The heat transfer coefficient between the laminated glass and the air is 8.0 W/m$^2$·K, and the temperature of the air is constantly 23° C. The voltage between the bus bars is 24 V.

Figure 19:
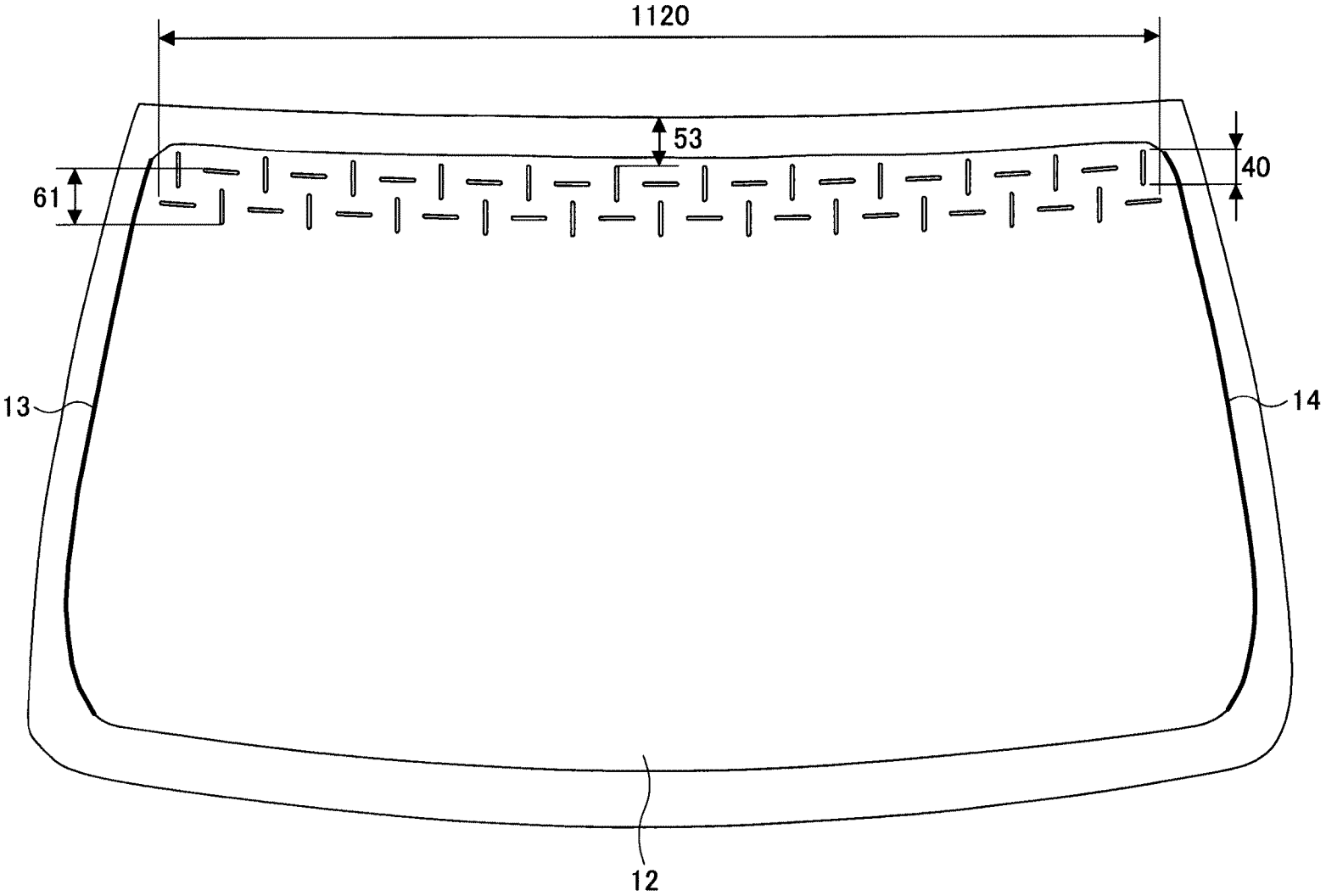
FIG. 19 is a schematic diagram illustrating the dimension and shape of laminated glass according to a fifth sample.
Figure 20:
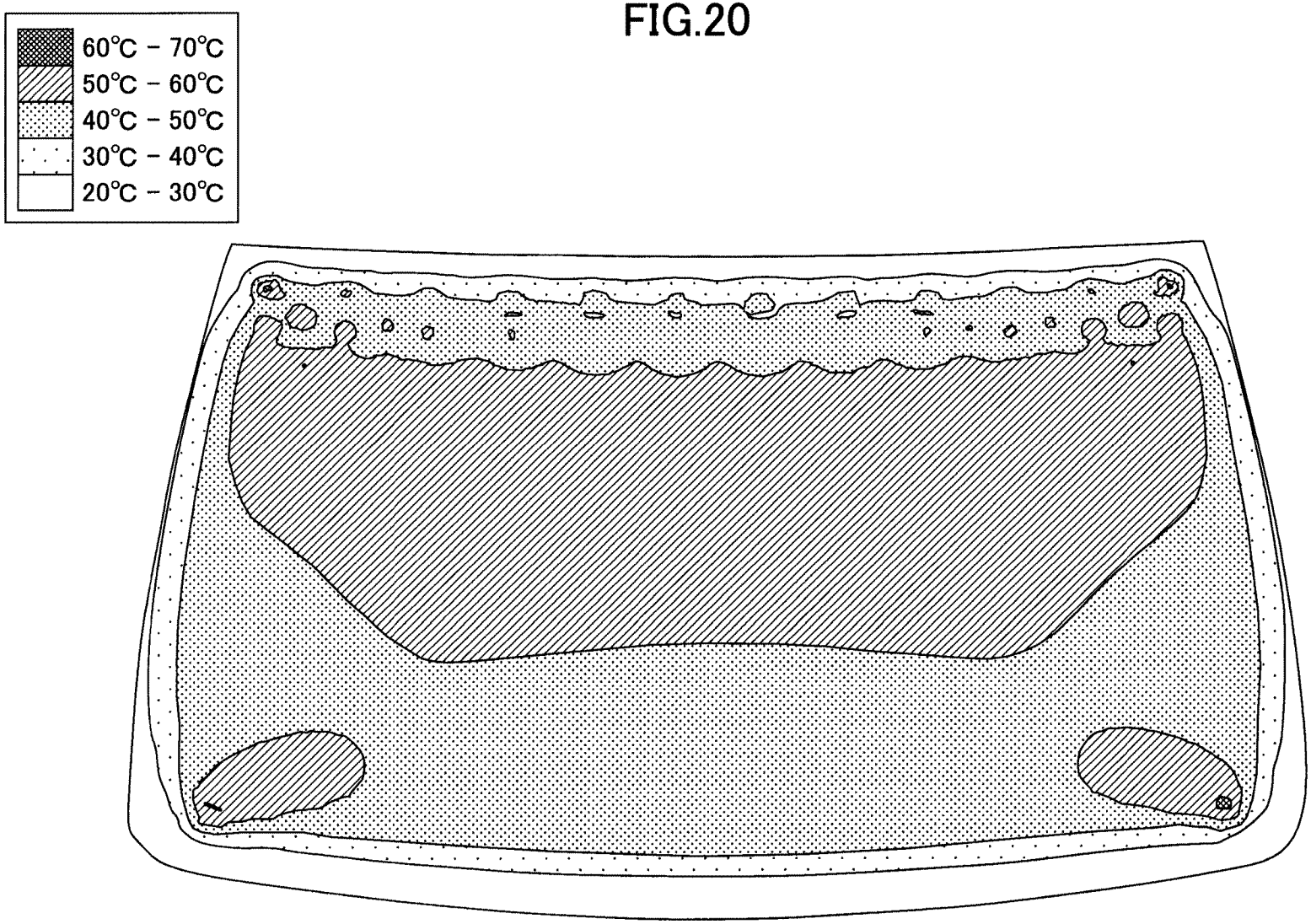
FIG. 20 is a schematic diagram illustrating temperature distribution of laminated glass according to the fifth sample when voltage is applied.
Figure 21:
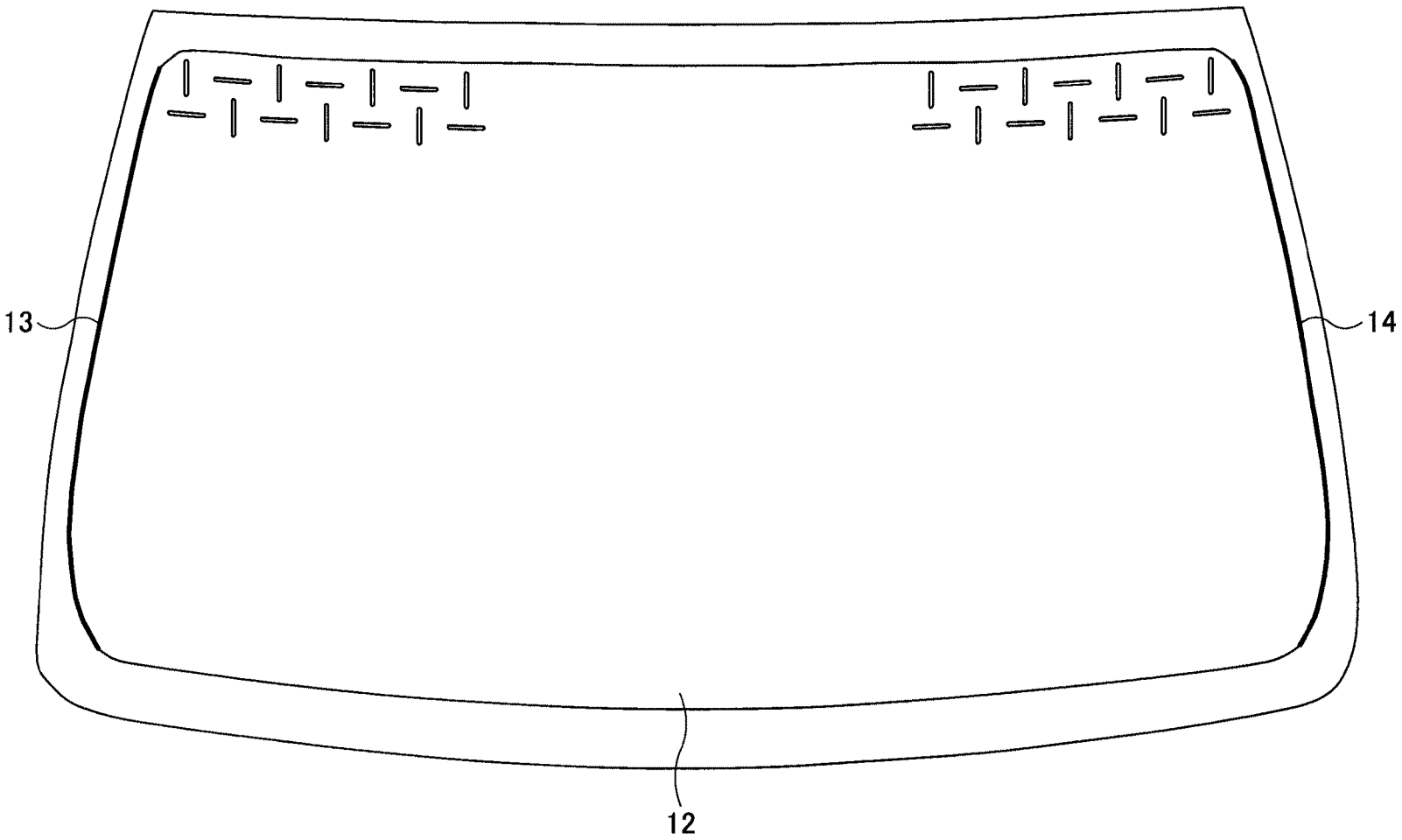
FIG. 21 is a schematic diagram illustrating the dimension and shape of laminated glass according to a sixth sample.
Figure 22:
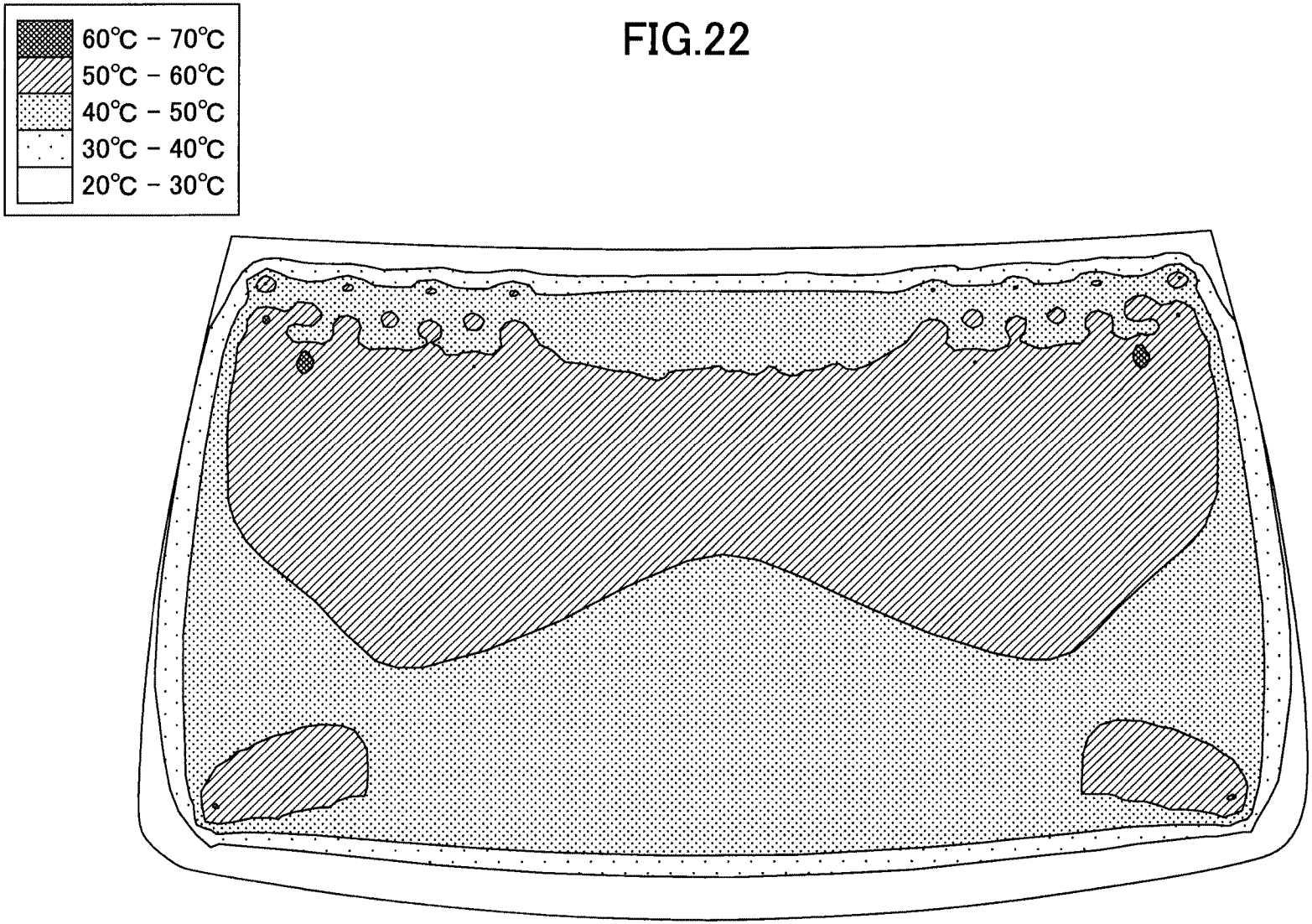
FIG. 22 is a schematic diagram illustrating temperature distribution of laminated glass according to the sixth sample when voltage is applied.
Figure 23:
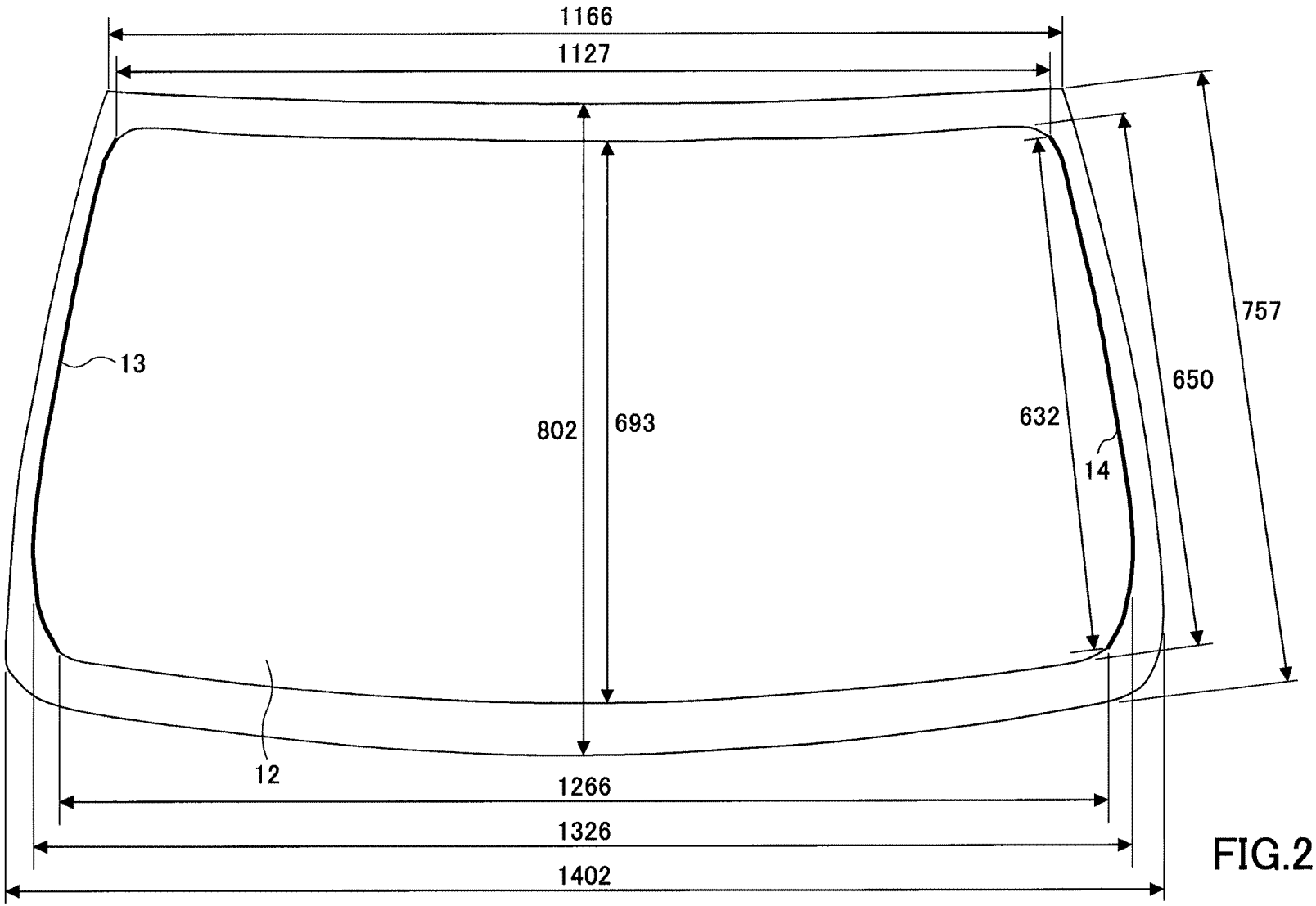
FIG. 23 is a schematic diagram illustrating the dimension and shape of laminated glass according to a seventh sample.
Figure 24:
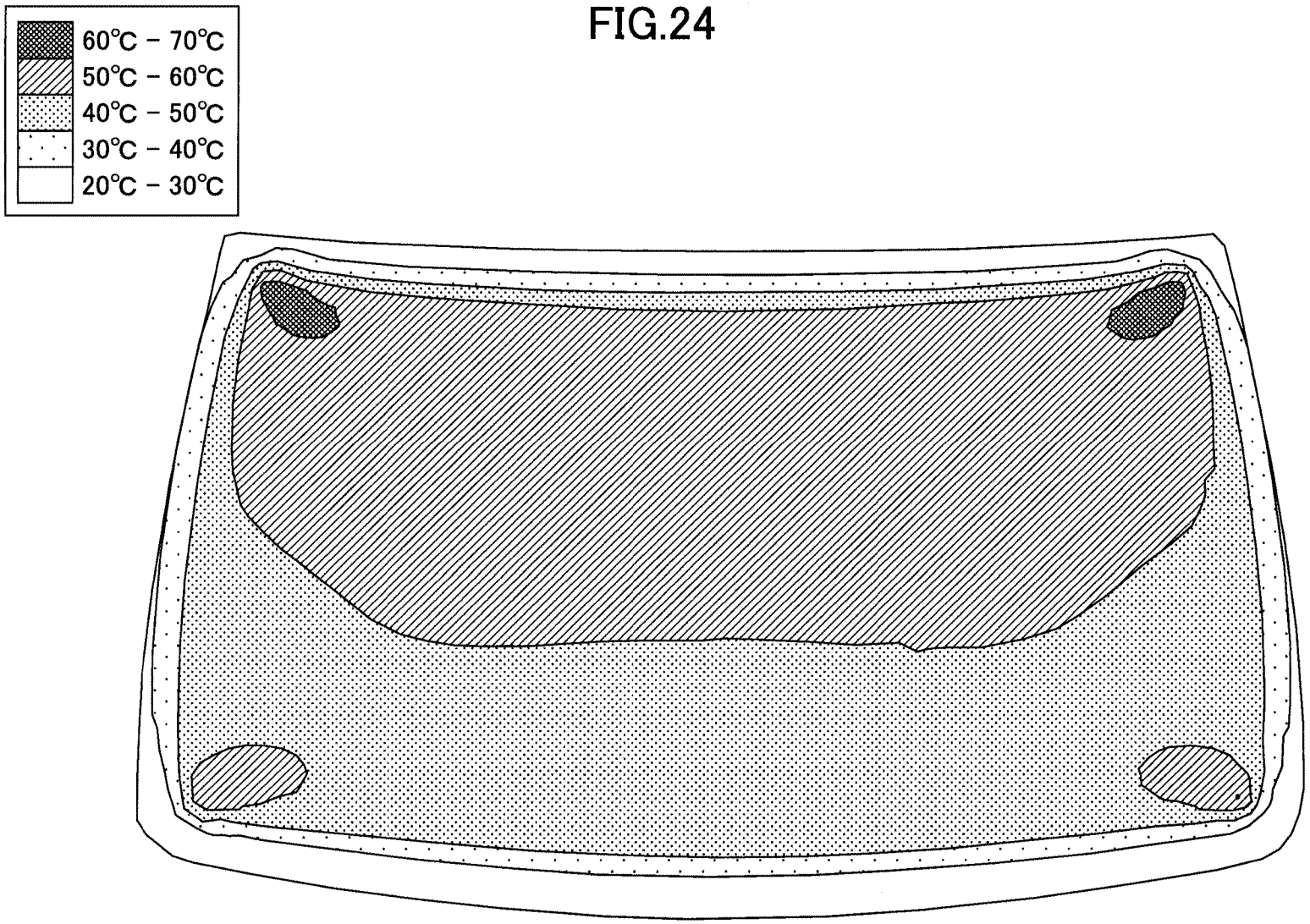
FIG. 24 is a schematic diagram illustrating temperature distribution of laminated glass according to the seventh sample when voltage is applied.

FIG. 19 is a schematic diagram illustrating the dimension and shape of laminated glass according to the fifth sample. FIG. 20 is a schematic diagram illustrating temperature distribution of laminated glass according to the fifth example when voltage is applied. FIG. 21 is a schematic diagram illustrating the dimension and shape of laminated glass according to the sixth sample. FIG. 22 is a schematic diagram illustrating temperature distribution of laminated glass according to the sixth example when voltage is applied. FIG. 23 is a schematic diagram illustrating the dimension and shape of laminated glass according to the seventh sample. FIG. 24 is a schematic diagram illustrating temperature distribution of laminated glass according to the seventh example when voltage is applied. In FIGS. 19, 21, and 23, reference numeral 12 indicates a transparent conductive film, reference numeral 13 indicates a left bus bar, reference numeral 14 indicates a right bus bar, and the other numerals indicate dimensions (mm). In FIGS. 20, 22, and 24, the symbol "-" representing a numeric range indicates that the value on its left side is included whereas the value on the right side is not included. For example, "20° C.-30° C." indicates a range that is greater than or equal to 20° C. but less than 30° C.

In the fifth to seventh samples, the analysis is performed under the same conditions except for the opening patterns of the transparent conductive films. As illustrated in FIG. 19, the fifth sample has an opening pattern that is similar to the opening pattern of FIG. 2 and formed throughout the transparent conductive film in the horizontal direction. As illustrated in FIG. 21, the sixth sample has an opening pattern that is similar to the opening pattern of FIG. 2 and formed in the transparent conductive film except for a center part in the horizontal direction. As illustrated in FIG. 23, the seventh sample has no opening pattern formed in the transparent conductive film.

As shown in FIGS. 19-24, it can be understood that local regions being heated to high temperature becomes smaller in the fifth and sixth samples compared to the seventh sample with no opening pattern because an opening pattern is formed in a region where the distance between the bus bars is short. Thus, the problem of local regions being heated to high temperatures is significantly improved.

Although embodiments of an electrically-heated window sheet material has been described above, the present invention is not limited to these embodiments, but variations and modifications may be made without departing from the scope of the present invention.

For example, the transparent conductive film 12 of the above-described embodiment has an upper side that is shorter than its lower side as illustrated in FIG. 1. However, the upper side may be longer than the lower side. In this case, the distance between the left bus bar 13 and the right bus bar 14 becomes longer from the lower side of the first region 21 to the upper side of the first region 21. Therefore, the openings having vertical dimensions greater than or equal to predetermined dimensions may be smaller toward the upper side.

Further, the left and right bus bars 13, 14 of the above-described embodiment extend from the upper end to the lower end of the transparent conductive film, respectively. However, the left and right bus bars 13, 14 may be divided into multiple parts throughout the upper end to the lower end of the transparent conductive film.

Further, not only may vertically polarized waves and horizontally polarized waves be allowed to transmit the multiple openings of the above-described embodiment but also circularly polarized waves may be transmitted.

Further, the first region 21 of the above-described embodiment is integrally formed with the second region 22. However, the first region 21 and the second region 22 may be provided apart from each other.

Hence, with the above-described embodiment of the present invention, there can be provided an electrically-heated window sheet material that improves the problem of local regions being heated to high temperatures.

The invention claimed is:

1. An electrically-heated window sheet material, comprising:

a transparent conductive film configured to generate heat and having a frequency selective surface that transmits horizontally polarized electromagnetic waves; and a plurality of bus bars positioned to supply electricity to the transparent conductive film, wherein the plurality of bus bars includes a left bus bar connected to a left edge of the transparent conductive film, and a right bus bar connected to a right edge of the transparent conductive film, the transparent conductive film includes a band-shaped first region interposed between the left bus bar and the right bus bar, a band-shaped second region interposed between the left bus bar and the right bus bar, and a plurality of openings formed in the band-shaped first region, the plurality of openings is formed in the transparent conductive film such that a current flowing in the band-shaped first region from one of the left and right bus bars to the other one of the left and right bus bars is bypassed by the openings and that the plurality of openings includes a plurality of vertical openings each having a vertical dimension and forming the frequency selective surface in the band-shaped first region of the transparent conductive film, and the transparent conductive film is formed such that the band-shaped second region does not have the plurality of openings.

2. The electrically-heated window sheet material as claimed in claim 1, wherein the plurality of vertical openings includes a plurality of first openings and a plurality of second openings formed at spaced-intervals in a horizontal direction, and a plurality of third openings that contact or overlap with first extended regions extending from the first openings in the horizontal direction toward the second openings and second extended regions extending from the second openings in the horizontal direction toward the first openings.

3. The electrically-heated window sheet material as claimed in claim 1, wherein the plurality of openings includes a plurality of openings formed in a staggered pattern in a horizontal direction.

4. The electrically-heated window sheet material as claimed in claim 1, wherein the left and right bus bars are spaced apart by a distance that gradually becomes longer from an upper to lower side of the band-shaped first region, and each of the vertical openings has the vertical dimensions that become smaller toward the lower side.

5. The electrically-heated window sheet material as claimed in claim 1, wherein the plurality of openings in the band-shaped first region includes a plurality of horizontal openings each having a horizontal dimension.

6. The electrically-heated window sheet material as claimed in claim 1, wherein the plurality of openings includes a plurality of cross openings each having a linear opening and a linear horizontal opening that intersect with each other such that the linear opening has a vertical dimension and that the linear horizontal opening has a horizontal dimension.

7. The electrically-heated window sheet material as claimed in claim 1, wherein the plurality of openings in the band-shaped first region includes a linear opening and a linear horizontal opening that are spaced apart from each other such that the linear opening has a vertical dimension and that the linear horizontal opening has a horizontal dimension.

8. The electrically-heated window sheet material as claimed in claim 5, wherein the horizontal opening forms a frequency selective surface that transmits a vertically polarized electromagnetic wave, and when a wavelength of the electrically-heated window sheet material is $\lambda_g=\lambda_0 \cdot k$ where $\lambda_0$ is an atmospheric wavelength of a center frequency of a frequency band of the vertically polarized electromagnetic wave, and k is a shortening coefficient of wavelength by the electrically-heated window sheet material, a horizontal dimension of the horizontal opening is greater than or equal to $(1/2) \cdot \lambda_g$.

9. The electrically-heated window sheet material as claimed in claim 1, wherein when a wavelength of the electrically-heated window sheet material is $\lambda_{g1}=\lambda_{01} \cdot k$ where $\lambda_{01}$ is an atmospheric wavelength of a center frequency of a frequency band of the horizontally polarized electromagnetic wave, and k is a shortening coefficient of wavelength by the electrically-heated window sheet material, the vertical dimension of the vertical opening is greater than or equal to $(1/2) \cdot \lambda_{g1}$ .

10. The electrically-heated window sheet material as claimed in claim 1, wherein the left bus bar and the right bus bar are spaced apart by a distance that is shorter in the band-shaped first region than in the band-shaped second region.

11. The electrically-heated window sheet material as claimed in claim 2, wherein the left and right bus bars are spaced apart by a distance that gradually becomes longer from an upper to lower side of the band-shaped first region, and each of the vertical openings has the vertical dimensions that become smaller toward the lower side.

12. The electrically-heated window sheet material as claimed in claim 3, wherein the left and right bus bars are spaced apart by a distance that gradually becomes longer from an upper to lower side of the band-shaped first region, and each of the vertical openings has the vertical dimensions that become smaller toward the lower side.

13. The electrically-heated window sheet material as claimed in claim 2, wherein the plurality of openings in the band-shaped first region includes a plurality of horizontal openings each having a horizontal dimension.

14. The electrically-heated window sheet material as claimed in claim 3, wherein the plurality of openings in the band-shaped first region includes a plurality of horizontal openings each having a horizontal dimension.

15. The electrically-heated window sheet material as claimed in claim 1, wherein the transparent conductive film is formed such that the band-shaped first region is no greater than 500 mm from an upper side of the transparent conductive film.

16. The electrically-heated window sheet material as claimed in claim 2, wherein when a wavelength of the electrically-heated window sheet material is $\lambda_{g1}=\lambda_{01} \cdot k$ where $\lambda_{01}$ is an atmospheric wavelength of a center frequency of a frequency band of the horizontally polarized electromagnetic wave, and k is a shortening coefficient of wavelength by the electrically-heated window sheet material, the vertical dimension of the vertical opening is greater than or equal to $(1/2) \cdot \lambda_{g1}$.

17. The electrically-heated window sheet material as claimed in claim 3, wherein when a wavelength of the electrically-heated window sheet material is $\lambda_{g1}=\lambda_{01}\cdot k$ where $\lambda_{01}$ is an atmospheric wavelength of a center frequency of a frequency band of the horizontally polarized electromagnetic wave, and k is a shortening coefficient of wavelength by the electrically-heated window sheet material, the vertical dimension of the vertical opening is greater than or equal to $(1/2)\cdot\lambda_{g1}$.

18. The electrically-heated window sheet material as claimed in claim 1, wherein the plurality of openings is formed such that each of the vertical openings has the vertical dimension that is formed in a range of 10 mm to 100 mm.

19. The electrically-heated window sheet material as claimed in claim 2, wherein the left bus bar and the right bus bar are spaced apart by a distance that is shorter in the band-shaped first region than in the band-shaped second region.

20. The electrically-heated window sheet material as claimed in claim 3, wherein the left bus bar and the right bus bar are spaced apart by a distance that is shorter in the band-shaped first region than in the band-shaped second region.

* * * * *